US008755735B2

(12) United States Patent
Okutsu

(10) Patent No.: US 8,755,735 B2
(45) Date of Patent: Jun. 17, 2014

(54) IMAGE FORMING APPARATUS AND PROGRAM PRODUCT FOR IMAGE FORMING

(75) Inventor: Akito Okutsu, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 433 days.

(21) Appl. No.: 13/231,089

(22) Filed: Sep. 13, 2011

(65) Prior Publication Data

US 2012/0070214 A1 Mar. 22, 2012

(30) Foreign Application Priority Data

Sep. 16, 2010 (JP) ..... 2010-208611

(51) Int. Cl.
*G03G 15/00* (2006.01)

(52) U.S. Cl.
USPC ..... 399/401; 399/388; 399/397; 271/291

(58) Field of Classification Search
CPC ..... B65H 2701/18262; B65H 2701/1826; B65H 2701/18265; B65H 2701/1872; G06F 3/1263; G06F 9/3836; G03G 15/5083; G03G 2215/2083; G03G 2215/00021
USPC ..... 399/388, 403, 405, 401, 382, 397; 271/291, 288, 301, 225
See application file for complete search history.

(56) References Cited

U.S. PATENT DOCUMENTS 8,047,542 B2 * 11/2011 Hara et al. ..... 271/270
8,390,857 B2 * 3/2013 Igarashi ..... 358/1.15

FOREIGN PATENT DOCUMENTS

JP 2002-96977 4/2002

* cited by examiner

*Primary Examiner* — Matthew G Marini
(74) *Attorney, Agent, or Firm* — Oblon, Spivak, McClelland, Maier & Neustadt, L.L.P.

(57) ABSTRACT

An image forming apparatus in one embodiment includes: a first paper feeding control unit; a transfer unit that transfers a toner image onto a front surface or a back surface of the sheet; a second paper feeding control unit that reverses the sheet whose front surface has been transferred; a first decision unit that decides a transfer order on each surface by interleaf control; an execution control unit that controls the transfer on the back surface; and a second decision unit that decides whether a second sheet is to be fed for being transferred. The execution control unit makes the second sheet be fed from the sheet staking unit. The first paper feeding control unit controls such that the first sheet is apart from the second sheet by a predetermined interval distance or more, without changing a transfer order.

10 Claims, 17 Drawing Sheets

FIG.5

PRINTING ORDER

| INTERLEAF SHEET NUMBER: ONE (NO INTERLEAF CONTROL) | | | | | | | | |
|---|---|---|---|---|---|---|---|---|
| PAPER: SHEET NUMBER | 1 | 1 | 2 | 2 | 3 | 3 | 4 | 4 |
| SURFACE | FRONT | BACK | FRONT | BACK | FRONT | BACK | FRONT | BACK |

| INTERLEAF SHEET NUMBER: TWO | | | | | | | | |
|---|---|---|---|---|---|---|---|---|
| PAPER: SHEET NUMBER | 1 | 2 | 1 | 3 | 2 | 4 | 3 | 4 |
| SURFACE | FRONT | FRONT | BACK | FRONT | BACK | FRONT | BACK | BACK |

| INTERLEAF SHEET NUMBER: THREE | | | | | | | | |
|---|---|---|---|---|---|---|---|---|
| PAPER: SHEET NUMBER | 1 | 2 | 3 | 1 | 4 | 2 | 3 | 4 |
| SURFACE | FRONT | FRONT | FRONT | BACK | FRONT | BACK | BACK | BACK |

IMAGE FORMING APPARATUS AND PROGRAM PRODUCT FOR IMAGE FORMING

CROSS-REFERENCE TO RELATED APPLICATIONS

The present application claims priority to and incorporates by reference the entire contents of Japanese Patent Application No. 2010-208611 filed in Japan on Sep. 16, 2010.

BACKGROUND OF THE INVENTION

1. Field of the Invention

The present invention relates to an image forming apparatus and program product for image forming.

2. Description of the Related Art

In duplex printing performed by an image forming apparatus, printing is performed on, for example, a front surface of a sheet that is fed from a sheet stacking unit (referred to as "front surface printing"); the sheet is reversed in a reverse-duplex path; and printing is performed on a back surface (referred to as "back surface printing"). In the case of performing printing, the sheet needs to reach a transfer position at which a toner image formed on a photosensitive element is transferred onto the sheet. In the case of performing both front surface printing and back surface printing on one piece of sheet, the sheet positioned at the transfer position at the time of front surface printing is reversed and then reaches the transfer position again via a predetermined path (the reverse-duplex path). Thus, in the case of performing duplex printing, the sheet passes through the reverse-duplex path before back surface printing after front surface printing. Thus, compared to the case when printing is continuously performed on one surface, the conveying distance increases between two surfaces of the sheets. Thus, an arrival of the sheet to the transfer position is delayed; and the number of prints per unit time of duplex printing (referred to as productivity) may be smaller than single-sided printing.

In this regard, as a technique for improving productivity of duplex printing, there has been implemented a method of changing a printing order at the time of duplex printing. This method is referred to as interleaf control. This method is based on the premise that sheets having undergone front surface printing are scattered on the reverse-duplex path. In this method, prior to back surface printing on the sheet having undergone front surface printing, front surface printing is performed on sheets by the number of sheets which can be scattered on the reverse-duplex path. Thereafter, back surface printing on the sheets having undergone front surface printing that are scattered on the reverse-duplex path and front surface printing on a sheet newly fed from the sheet stacking unit are alternately performed. In this case, it is possible to efficiently use a time until the sheet reaches the transfer position via the reverse-duplex path after front surface printing. However, in the interleaf control, since a mechanical configuration for scattering a plurality of sheets on the reverse-duplex path is necessary, implementation conditions are restricted. For this reason, when it is difficult to perform the interleaf control, duplex printing is performed in a conventional printing order such that front surface printing is performed one sheet; the sheet is conveyed to the transfer position via the reverse-duplex path and subjected to duplex printing; and then front surface printing and back surface printing are performed on the next sheet in the same manner.

However, in conventional duplex printing, regardless of the implementation of interleaf control, timing for newly feeding a new front surface printing target sheet (referred to as "front surface printing sheet") from the sheet stacking unit after back surface printing performed on the sheet having undergone front surface printing is later than feeding timing of a target paper which is to be precedingly subjected to back surface printing (referred to as "back surface printing target sheet"). For this reason, in a conveying layout in which a sheet arrival time from the feeding position (the sheet stacking unit) of the front surface printing target sheet to the transfer position is longer than a sheet arrival time from the feeding position of the back surface printing target sheet to the transfer position, the productivity may decrease.

In recent years, there has been developed an image forming apparatus that prevents a decrease in productivity at the time of duplex printing even when a distance from the feeding position of the front surface printing target sheet to the transfer position is lengthy. For example, according to a technique disclosed in Japanese Patent Application Laid-open No. 2002-096977, paper feeding timing is managed in view of both a transfer order and a paper feeding order; in the interleaf control at the time of duplex printing, when the distance between the sheet stacking unit, from which the front surface printing target sheet is newly fed after back surface printing is performed on the sheet having undergone front surface printing, and the transfer position is lengthy, a paper feeding order changes, so that the sheet is fed from the sheet stacking unit prior to the back surface printing target sheet.

However, in the technique disclosed in Japanese Patent Application Laid-open No. 2002-096977, it has been difficult to resolve the problem in that productivity decreases at the time of duplex printing when the interleaf control is not performed. Further, in the technique disclosed in Japanese Patent Application Laid-open No. 2002-096977, as long as there is a printing request, if a condition such as a distance or paper feeding from a certain sheet stacking unit is satisfied, the front surface printing target sheet is precedingly fed. Thus, there may be fed sheets which are more than the number of sheets necessary for satisfying prescribed productivity. For this reason, software control for sheet control becomes complicated, and thus the consumption of a memory resource such as a random access memory (RAM) used for the software control may increase.

Further, it is necessary to guarantee a printing order or a sheet interval between the front surface printing target sheet which is precedingly fed and the preceding back surface printing target sheet. That is, when timing of the front surface printing target sheet fed from the sheet stacking unit is not adjusted anywhere, the front surface printing target sheet may pass the preceding back surface printing target sheet or may bump into the preceding back surface printing target sheet, leading to paper jamming.

SUMMARY OF THE INVENTION

It is an object of the present invention to at least partially solve the problems in the conventional technology.

According to an aspect of the present invention, there is provided an image forming apparatus, including: a first paper feeding control unit that feeds a sheet from a sheet stacking unit housing the sheet and conveys the sheet to a transfer position at which a transfer unit is disposed; a transfer unit that transfers a toner image formed on a photosensitive element onto a front surface or a back surface of the sheet; a second paper feeding control unit that reverses the sheet on which a transfer on the front surface has been already performed and then conveys the sheet to the transfer position via a first paper feeding position when a transfer is to be performed on each of both sides of the sheet; a first decision unit that decides a transfer order on each surface of each of a plurality of sheets when transfer is to be performed by interleaf control according to a print job instructing printing on both sides of the plurality of sheets; an execution control unit that controls the first paper feeding control unit at the time of transfer on the front surface of each sheet based on an order decided by the first decision unit according to the print job, makes the sheet fed from the sheet stacking unit, controls transfer performed by the transfer unit on the front surface of the sheet, controls the second paper feeding control unit at the time of transfer on the back surface, makes the sheet fed from the first paper feeding position, and controls transfer performed by the transfer unit on the back surface of the sheet; and a second decision unit that, when a predetermined condition is satisfied, decides that a second sheet, which is a transfer target on a front surface subsequent to the transfer on a back surface of a first sheet, is to be fed from the sheet stacking unit, earlier than the first sheet, in which transfer on a front surface has been finished and which is a transfer target on the back surface, is fed from the first paper feeding position. The execution control unit controls the first paper feeding control unit according to a decision of the second decision unit and makes the second sheet be fed from the sheet stacking unit, and the first paper feeding control unit controls the conveyance of the second sheet from the sheet stacking unit to the transfer position such that the first sheet is apart from the second sheet by a predetermined sheet interval distance or more without changing a transfer order on the back surface of the first sheet and a transfer order on the front surface of the second sheet fed from the sheet stacking unit, according to the decision of the second decision unit.

According to another aspect of the present invention, there is provided a computer program product including a non-transitory computer usable medium having computer readable program codes embodied in the medium that when executed cause a computer used in an image forming apparatus to execute functions as: a first paper feeding control unit that feeds a sheet from a sheet stacking unit housing the sheet and conveys the sheet to a transfer position at which a transfer unit is disposed; a second paper feeding control unit that reverses the sheet on which a transfer on a front surface has been already performed and then conveys the sheet to the transfer position via a first paper feeding position when a transfer is to be performed on each of both sides of the sheet transferred by a transfer unit that transfers a toner image formed on a photosensitive element onto the front surface or a back surface of the sheet; a first decision unit that decides a transfer order on each surface of each of a plurality of sheets when transfer is to be performed by interleaf control according to a print job instructing printing on both sides of the plurality of sheets; an execution control unit that controls the first paper feeding control unit at the time of transfer on the front surface of each sheet based on an order decided by the first decision unit according to the print job, makes the sheet fed from the sheet stacking unit, controls transfer performed by the transfer unit on the front surface of the sheet, controls the second paper feeding control unit at the time of transfer on the back surface, makes the sheet fed from the first paper feeding position, and controls transfer performed by the transfer unit on the back surface of the sheet; and a second decision unit that, when a predetermined condition is satisfied, decides that a second sheet, which is a transfer target on a front surface subsequent to the transfer on a back surface of a first sheet, is to be fed from the sheet stacking unit, earlier than the first sheet, in which transfer on a front surface has been finished and which is a transfer target on the back surface, is fed from the first paper feeding position. The execution control unit controls the first paper feeding control unit according to a decision of the second decision unit and makes the second sheet be fed from the sheet stacking unit, and the first paper feeding control unit controls the conveyance of the second sheet from the sheet stacking unit to the transfer position such that the first sheet is apart from the second sheet by a predetermined sheet interval distance or more without changing a transfer order on the back surface of the first sheet and a transfer order on the front surface of the second sheet fed from the sheet stacking unit, according to the decision of the second decision unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5 is a diagram illustrating a printing order according to an interleaf sheet number when duplex printing is performed on four sheets;

DETAILED DESCRIPTION OF THE PREFERRED EMBODIMENTS

Figure 1:
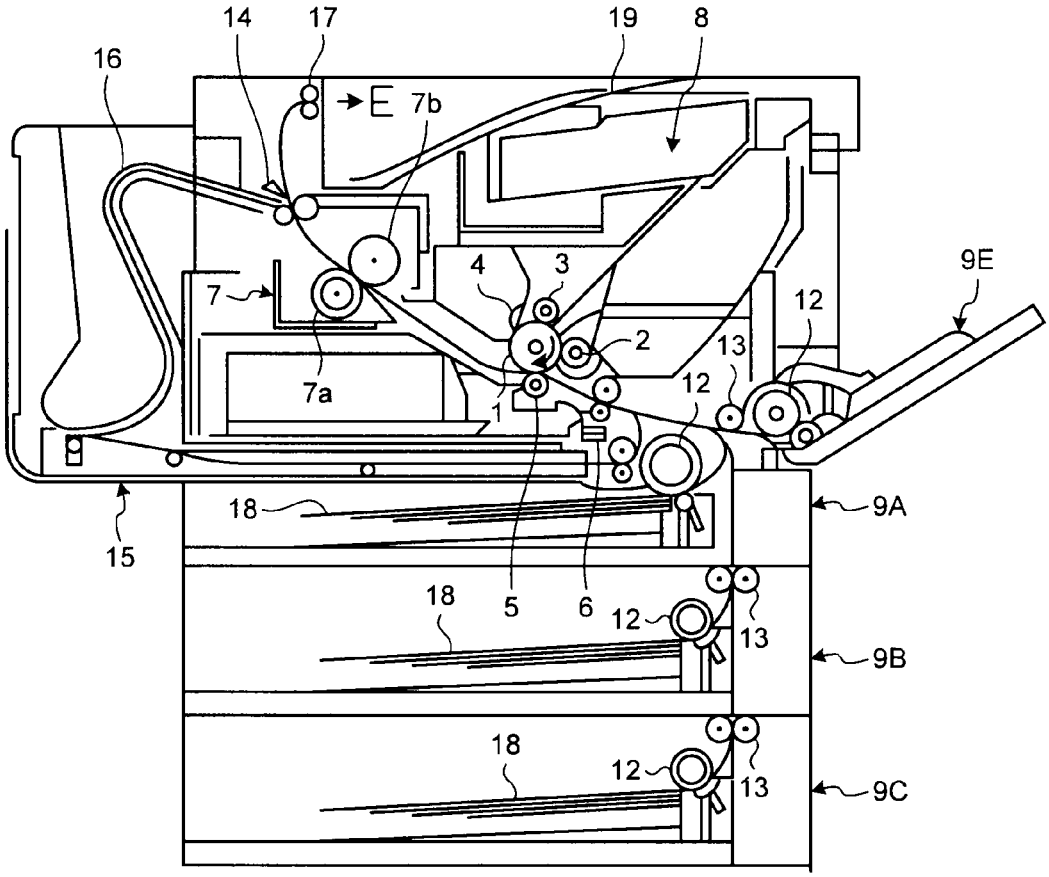
FIG. 1 is a diagram illustrating a hardware configuration of an image forming apparatus according to the present embodiment.

Hereinafter, embodiments of an image forming apparatus and computer program product for image forming will be described with reference to the accompanying drawings.

In the present embodiment, a laser printer will be described as an example of an image forming apparatus. An overview of a hardware configuration of an image forming apparatus according to the present embodiment will be described with reference to FIG. 1. The image forming apparatus includes an image forming unit that is configured with a photosensitive element 1, a developing roller 2, a charging roller 3, a cleaning blade 4, a transfer roller 5, and a registration roller 6, a fixing unit 7, a writing unit 8 including an optical system, paper feed trays 9A, 9B, and 9C, a paper feeding roller 12, a bypass tray 9E, a bifurcating claw 14, a re-feed (duplex) unit 15 including a duplex conveying path 16, and a discharging roller 17. The image forming apparatus implements printing functions such as a copying function and a printer function.

Each of the paper feed trays 9A, 9B, and 9C and the bypass tray 9E includes a sheet stacking unit in which sheets are housed. Each unit feeds the housed sheet with the driving of the paper feeding roller 12. The sheet is conveyed to the registration roller 6 and then supplied to the image forming unit. However, when it is not necessary to discriminate the paper feed trays 9A, 9B, and 9C, they may be collectively referred to as a paper feed tray 9. The re-feed unit 15 reverses a sheet having an image formed on its front surface and conveys the reversed sheet to the image forming unit again. That is, the re-feed unit 15 re-supplies the sheet. The fixing unit 7 includes a heating roller 7*a* and a pressing roller 7*b*. In the heating roller 7*a*, a heat generating unit is held inside the roller in parallel in an axial direction; a thermistor that detects a surface temperature is installed on the surface; and so a temperature necessary fixing can be controlled. The optical system included in the writing unit 8 includes a polygon mirror, a cylindrical lens, or a laser diode (LD).

In the image forming apparatus, the photosensitive element 1 is driven by a motor (not shown) in a direction of an arrow. The surface of the photosensitive element 1 is uniformly charged by the charging roller 3 and scanned with a laser beam modulated based on image data injected from the writing unit 8; so that an electrostatic latent image is formed on the surface of the photosensitive element 1. Thereafter, a toner image is formed by a developing process for fixing a toner through the developing roller 2. Then, at paper feeding timing, driven is the paper feeding roller 12 and a paper feeding roller 13 of any one of the paper feed tray 9, the bypass tray 9E, or the re-feed unit 15; a sheet 18 is conveyed to the registration roller 6; the registration roller 6 adjusts timing of the sheet to coincide with a front end of the toner image on the photosensitive element 1 (position alignment); and the sheet is sent to the transfer position with the driving the registration roller 6. Here, the vicinity of a certain position of the registration roller 6 is referred to as a pre-transfer position. Further, a plurality of sensors (not shown) that detect the sheet are disposed near the registration roller between the paper feed tray 9 and the bypass tray 9E and the pre-transfer position.

The toner image on the photosensitive element 1 is transferred onto the sheet positioned at the transfer position through the transfer roller 5. Thereafter, the sheet is conveyed to the fixing unit 7; the fixing unit 7 applies head and pressure to the toner image and fixes the toner image onto the sheet; and then the sheet is discharged to a discharge tray 19 present in a direction of an arrow E through the bifurcating claw 14 and the discharging roller 17.

In the case of duplex printing, a sheet having an image formed on its one surface is conveyed to the re-feed unit 15 through the bifurcating claw 14; reversed through the reverse-duplex path; re-fed to the registration roller 6 again through the paper feeding roller 12 and the paper feeding roller 13; and conveyed to the image forming unit by the registration roller 6 at predetermined timing. Then, a toner image of a back surface is transferred onto the sheet; the toner image is fixed by the fixing unit 7; and then discharged to the discharge tray 19 by the bifurcating claw 14 and the discharging roller 17.

Figure 2:
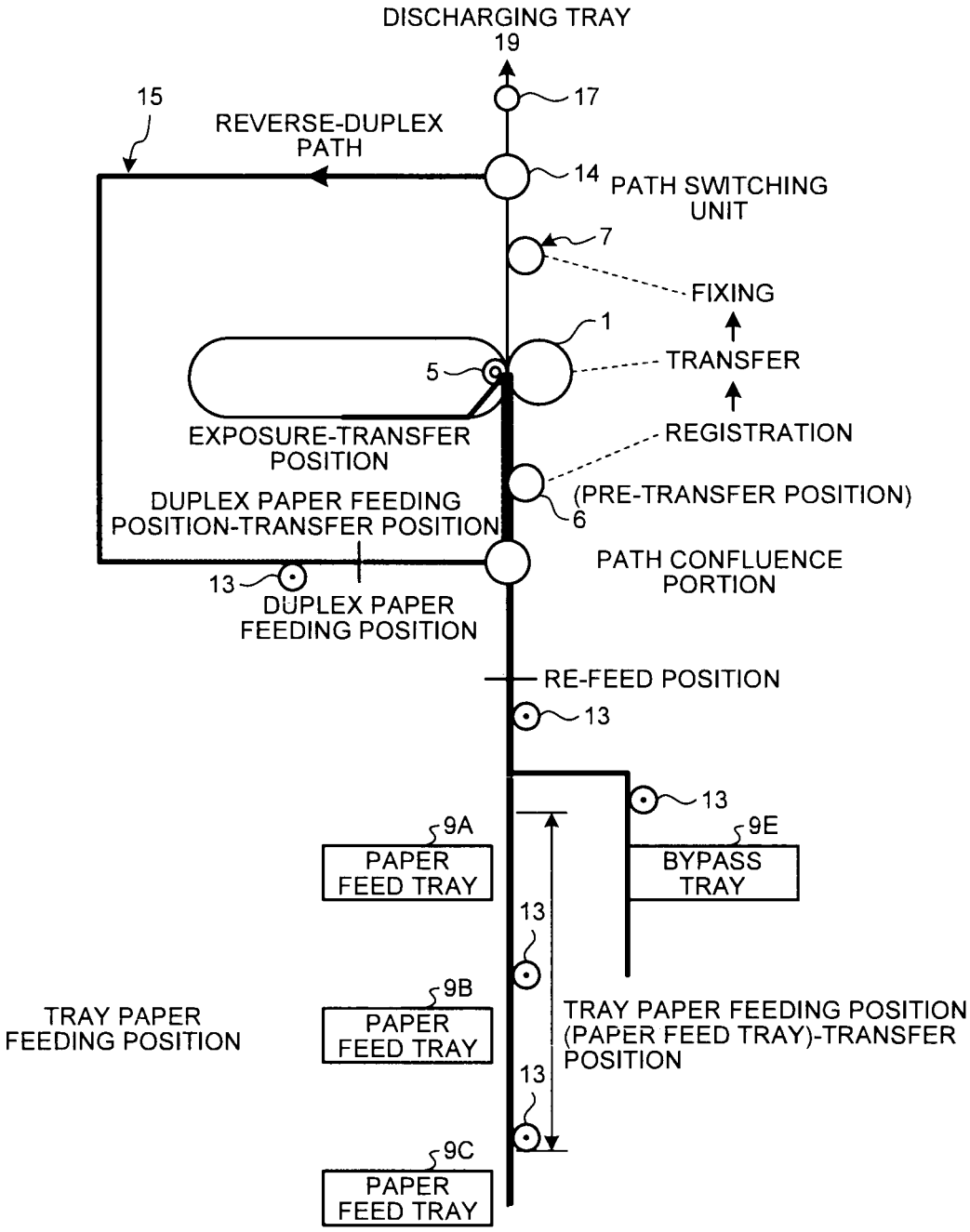
FIG. 2 is a diagram illustrating an overview of a conveying path of a sheet at the time of printing.

Here, an overview of the conveying path of the sheet at the time of printing will be described with reference to FIG. 2. In single-sided surface printing, front surface printing is performed such that the sheet is fed from any one of the paper feed tray 9 and the bypass tray 9E; the sheet is conveyed to the registration roller 6 by the paper feeding roller 13; transfer of the toner image and alignment between the toner image and the sheet are performed by the registration roller 6; the sheet is conveyed to the transfer position at which the toner image is transferred by the transfer roller 5; the toner image is transferred onto the sheet; and then the toner image is fixed onto the sheet by the fixing unit 7. Thereafter, the conveying path is switched to the discharging roller 17 side by the bifurcating claw 14; and the sheet having undergone front surface printing is conveyed to the discharging roller 17 and discharged.

Meanwhile, in duplex printing, after front surface printing is performed, back surface printing is performed such that the bifurcating claw 14 switches the conveying path to the reverse-duplex path at the re-feed unit 15 side; the sheet having undergone front surface printing is reversed in the reverse-duplex path and conveyed to the registration roller 6 again by the paper feeding roller 12 and the paper feeding roller 13; transfer of the toner image and alignment between the toner image and the sheet are adjusted in the registration roller 6; the sheet is conveyed to the transfer position; the toner image of the back surface is transferred onto the sheet; and the toner image is fixed onto the sheet by the fixing unit 7. Thereafter, the conveying path is switched to the discharging roller 17 side by the bifurcating claw 14; and the sheet having undergone both front surface printing and back surface printing is conveyed to the discharging roller 17 and discharged to the discharge tray 19.

Here, a confluence point between the reverse-duplex path and the conveying path for front surface printing is referred to as a path confluence portion. In the reverse-duplex path, a position apart from the registration roller 6 to the path confluence portion side by a first predetermined distance is referred to as a duplex paper feeding position. At the duplex paper feeding position, adjusted is a sheet interval with a sheet precedingly conveyed to the transfer position. That is, timing of the sheet conveyed to the registration roller 6 is adjusted such that the sheet conveyed to the vicinity of the duplex paper feeding position is prevented from being conveyed to the transfer position prior to the sheet precedingly conveyed to the transfer position (referred to as "preceding sheet") or from being bumped into the preceding sheet. To this end, driving and the suspension of driving of the paper feeding roller 13 arranged in the vicinity of the duplex paper feeding position is controlled; and controlled is the conveyance of the sheet, which has been conveyed to the vicinity of the duplex paper feeding position, to the registration roller 6.

However, as illustrated in FIG. 1, in the distance to the transfer position, the paper feed tray 9C is most distant; the paper feed tray 9B is next; and the paper feed tray 9A is shortest. Thus, when the sheet is fed from the paper feed tray 9C, a time taken for reaching the transfer position is longer than when the sheet is fed from the paper feed tray 9C, so that productivity may possibly decrease. For example, let us assume that at the time of duplex printing, subsequent to a printing process of performing back surface printing, a new sheet used for a printing process of performing front surface printing is fed, for example, from the paper feed tray 9C. In this case, when the sheet stats to be fed from the paper feed tray 9C at timing for conveying the sheet used for printing process of performing back surface printing from the duplex paper feeding position to the transfer position, since it takes a time for the sheet to reach the transfer position, it is difficult to perform front surface printing immediately after performing back surface printing, and thus productivity may possibly decrease.

For this reason, in the present embodiment, in order to suppress a decrease in productivity at the time of duplex printing, the position apart from the conveying path for front surface printing to the paper feed tray 9 side by a second predetermined distance is used as a re-feed position; when the interleaf control is executed at the time of duplex printing, a sheet interval with the sheet precedingly conveyed to the transfer position is adjusted at this re-feed position. That is, timing of the sheet conveyance to the registration roller 6 is adjusted such that the sheet conveyed to the vicinity of the re-feed position is prevented from being conveyed to the transfer position prior to the sheet precedingly conveyed to the transfer position (the preceding sheet) or from being bumped into the preceding sheet. A sensor that detects the sheet is disposed in the vicinity of the re-feed position. Based on a detection result of the sensor, controlled is driving and the suspension of driving of the paper feeding roller 13 arranged in the vicinity of the re-feed position; and adjusted is the conveyance of the sheet, conveyed to the vicinity of the duplex paper feeding position, to the registration roller 6. The control is performed by a controller and an engine control unit which will be described later. The details will be described later.

Further, when the interleaf control is executed, necessary is a configuration for causing sheets corresponding to the number of interleaf sheets which will be described later to be scattered on the reverse-duplex path. This is the premise necessary not to cause a paper jam when the interleaf control is executed. A unit that causes the sheets to be scattered on the reverse-duplex path is implemented by using a roller that causes the sheet to be on standby at each standby position on the reverse-duplex path or conveys the sheet from each standby position in terms of the restriction of the sheet size and the cost and controlling driving and the suspension of driving of the roller. Further, disposed is a plurality of sensors that detect the sheet on the reverse-duplex path. The conveying speed of each sheet or the distance of the sheet between before and after the conveyance is calculated based on detection results of the sensors. The conveyance of the sheet is controlled based on a calculation result. Particularly, at least one sensor is disposed in the vicinity of the duplex paper feeding position. The control is performed by a controller and an engine control unit which will be described later. Here, a tray for causing each sheet to be on standby in the reverse-duplex path may be separately disposed.

Figure 3:
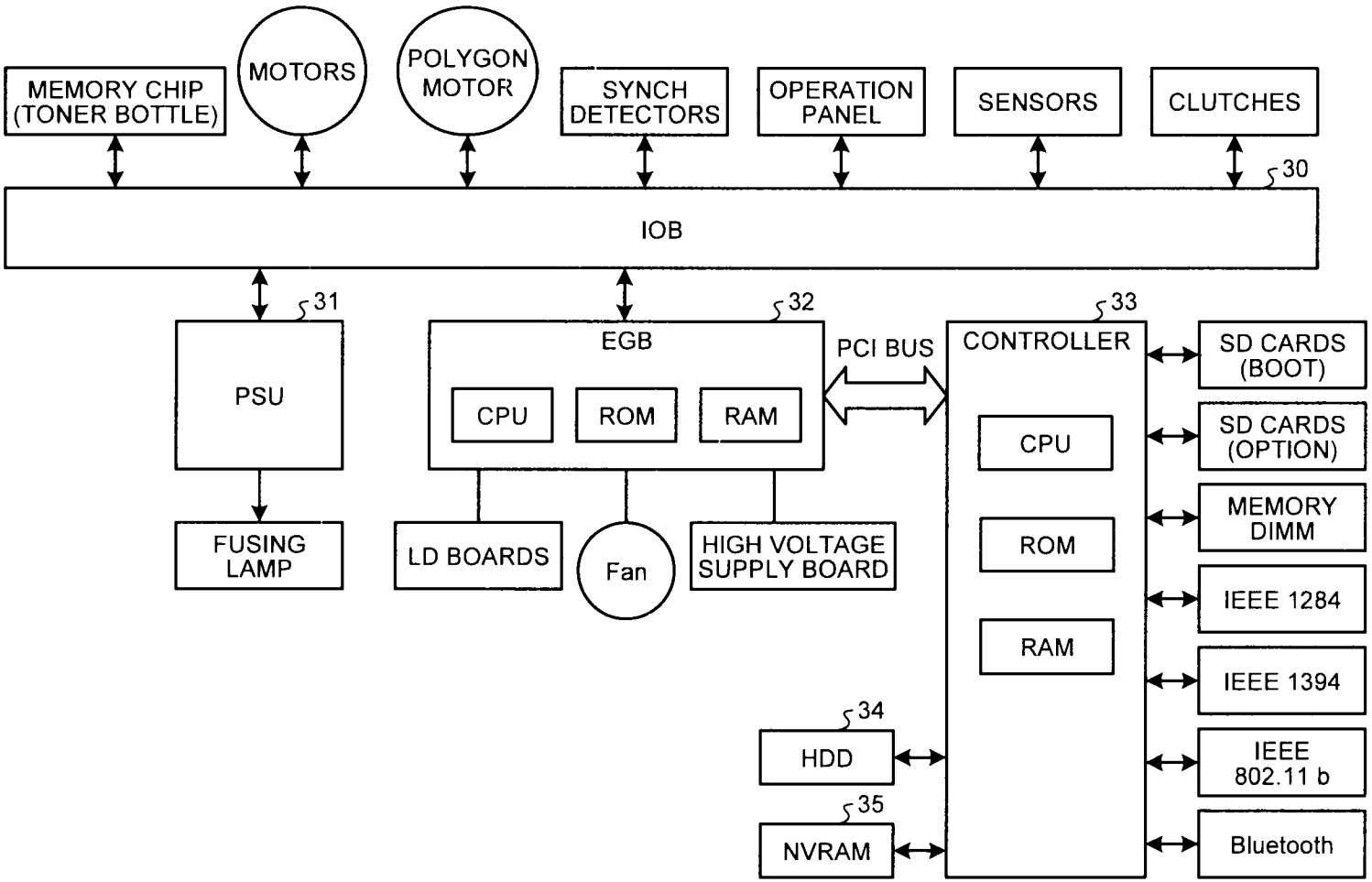
FIG. 3 is a diagram illustrating a system configuration of an image forming apparatus.

Next, a system configuration of an image forming apparatus will be described with reference to FIG. 3. The image forming apparatus includes an input output board (IOB) 30, a power supply unit (PSU) 31, an engine control unit (EGB) 32, a controller 33, a hard disk drive (HDD) 34, a non-volatile random access memory (NVRAM) 35, and interfaces. Under control of the engine control unit 32, the IOB 30 controls a motor for driving the image forming unit, the paper feeding roller 12, the paper feeding roller 13, and the discharging roller 17, a polygon motor for driving a polygon mirror included in the optical system included in the writing unit 8, a variety of sensors such as a sensor for detecting sheets set on the paper feed trays 9A, 9B, and 9C and a thermistor for detecting a fixing temperature in the fixing unit 7, an operation panel that receives an operation input from the user or displays information, and a variety of loads such as a clutch. An operation input of instructing printing may be input from the operation panel.

The engine control unit 32 includes a central processing unit (CPU), a read only memory (ROM) that stores a variety of data or a variety of programs, and a random access memory (RAM). Under control of the controller 33, by executing a variety of programs stored in the ROM, the CPU of the engine control unit 32 controls the IOB 30; controls a variety of loads; controls an LD or a fan included in the optical system included in the writing unit 8; and implements a variety of functions. Examples of the interfaces include an SD card interface, memory dual inline memory module (DIMM), IEEE1284, IEEE1394, IEEE802.11b, Bluetooth, and a communication interfaces for communication with an external information processing device. Print instruction data for instructing printing is received from an external information processing device via the communication interfaces.

The controller 33 includes a CPU, a ROM that stores a variety of data or a variety of programs, and a RAM. The controller 33 controls the overall image forming apparatus and implements a variety of functions. Specifically, for example, by executing a variety of programs stored in the ROM, the HDD 34, or the NVRAM 35, the CPU of the controller 33 controls input and output via each interface; acquires print instruction data received via the communication interface; receives an operation input for instructing printing from the user through the operation panel; and control the printing by receiving a print job and performing a printing process in response to the print instruction data or the operation input. The print job may include various print conditions such as designation of the sheet size, the sheet quality, or magnification, but for simple description, a description of these print conditions will be omitted. In the present embodiment, a description will be made in connection with a case in which the print job includes at least an instruction for performing duplex printing, the number of sheets which are a target on which duplex printing is performed, and each image printed on each surface. The HDD 34 and the NVRAM 35 store a variety of data and a variety of program, respectively. The PSU 31 converts an alternating current (AC) voltage supplied from an AC power supply into a direct current (DC) voltage and supplies each load via IOB 30 with the DC voltage.

Figure 4:
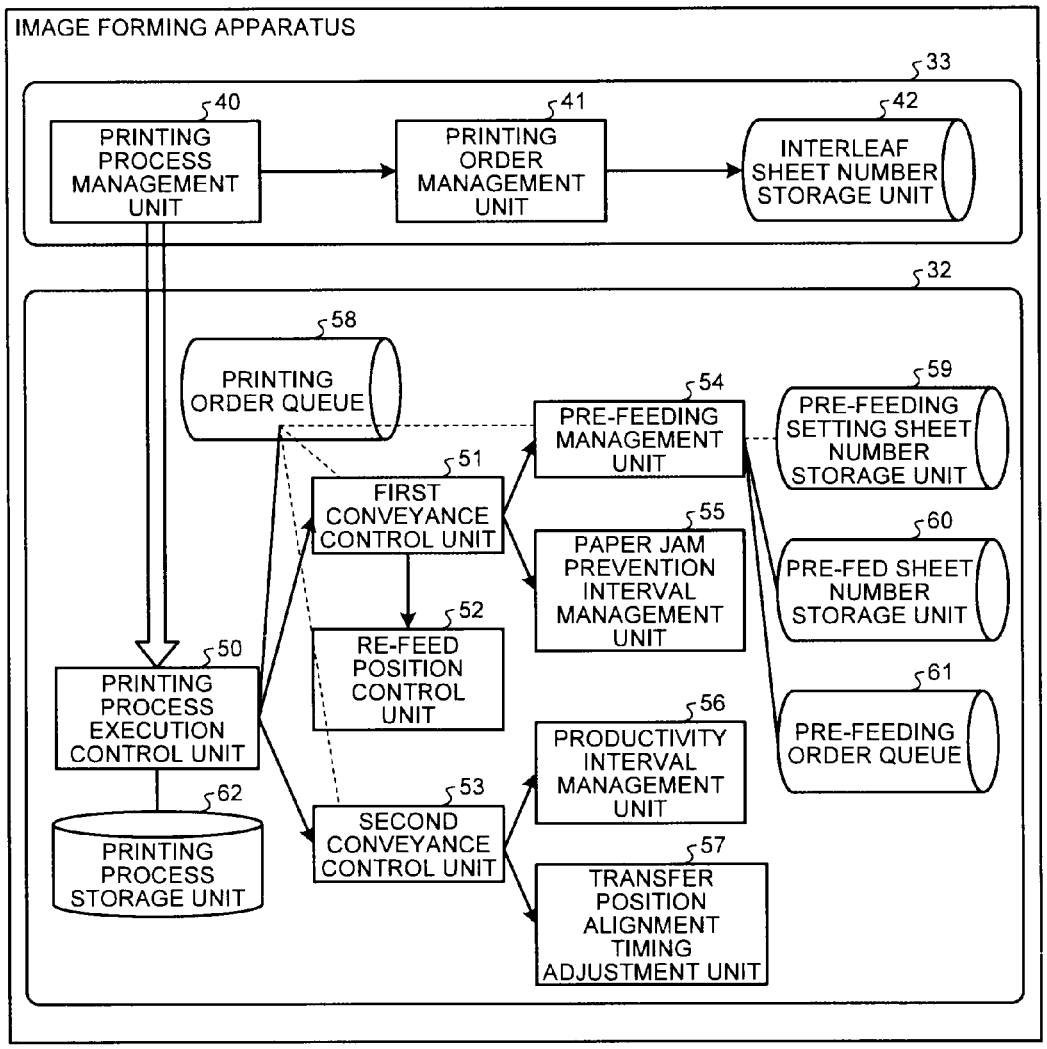
FIG. 4 is a diagram schematically illustrating various functions uniquely executed in an image forming apparatus of the present embodiment.

Next, a description will be made in connection with various functions uniquely executed in the image forming apparatus of the present embodiment by executing a variety of programs through the CPU of the controller 33 and the CPU of the engine control unit 32. FIG. 4 is a diagram schematically illustrating various functions uniquely executed in the image forming apparatus of the present embodiment. The functions are greatly divided into a block of receiving the print job, generating a printing process, and managing a printing order and a block of controlling execution of the printing process. The former block includes a printing process management unit 40, a printing order management unit 41, and an interleaf sheet number storage unit 42. The printing process management unit 40 and the printing order management unit 41 are generated, for example, on a RAM of the engine control unit 32 when the CPU of the controller 33 executes a program. The interleaf sheet number storage unit 42 is provided, for example, in a storage area of the HDD 34. The latter block includes a printing process execution control unit 50, a first conveyance control unit 51, a re-feed position control unit 52, a second conveyance control unit 53, a pre-feeding management unit 54, a paper jam prevention interval management unit 55, a productivity interval management unit 56, a transfer position alignment timing adjustment unit 57, a printing order queue 58, a pre-feeding setting sheet number storage unit 59, a pre-fed sheet number storage unit 60, a pre-feeding order queue 61, and a printing process storage unit 62. The printing process execution control unit 50, the first conveyance control unit 51, the re-feed position control unit 52, the second conveyance control unit 53, the pre-feeding management unit 54, the paper jam prevention interval management unit 55, the productivity interval management unit 56, and the transfer position alignment timing adjustment unit 57 are generated, for example, on a RAM of the controller 33 when the CPU of the engine control unit 32 executes a program. The printing process storage unit 62, the printing order queue 58, the pre-fed sheet number storage unit 60, and the pre-feeding order queue 61 are stored, for example, in a storage area of a RAM of the engine control unit 32. The pre-feeding setting sheet number storage unit 59 is provided for example, in a storage area of a ROM of the engine control unit 32.

The printing process management unit 40 receives the print job in response to the print instruction data or the operation input from the user; generates a printing process by dividing the print job into printing processes of page units; and requests the printing process execution control unit 50 to execute the printing process in the printing order. Specifically, for example, when the print job represents an instruction for performing duplex printing on four sheets, the printing process management unit 40 generates the printing process for each surface of sheets corresponding to the print job. As a result, generated are eight printing processes including first front surface printing, first back surface printing, second front surface printing, second back surface printing, third front surface printing, third back surface printing, fourth front surface printing, and fourth back surface printing.

When the print job represents an instruction for performing duplex printing, the printing order management unit 41 decides the printing order of the printing processes generated by the printing process management unit 40 so that the printing processes can be executed by the interleaf control.

Here, a description will be made in connection with the interleaf control. The interleaf control is widely usually used as a unit that improves productivity of duplex printing as described above in "Description of the Related Art". In the interleaf control, in order to efficiently use a time until the sheet having undergone front surface printing is returned to the transfer position via the reverse-duplex path again, the printing order of the printing processes is efficiently rearranged. At the time of rearrangement, the printing order of the printing processes changes according to how many sheets are to be consecutively subjected to front surface printing, starting from the first sheet, before first back surface printing starts. The number of sheets which are consecutively subjected to front surface printing starting from the first sheet is referred to as an interleaf sheet number. For example, if the interleaf sheet number is n (n is a positive number equal to or more than 1), the printing order is decided by the following principles (a) to (c): (a) n sheets in the lead are consecutively subjected to front surface printing; (b) front surface printing and back surface printing are alternately performed when surfaces that are more in number than n are not subjected to printing yet (sheet number of not-yet-printed>n); and (c) lastly, n sheets are consecutively subjected to back surface printing.

FIG. 5 is a diagram illustrating a printing order according to an interleaf sheet number when duplex printing is performed on four sheets. When the interleaf sheet number is one, the printing order is the same as when the interleaf control is not performed as in the conventional art. When the interleaf sheet number is two, as illustrated in FIG. 5, the printing order is an order of a first front surface, a second front surface, a first back surface, a third front surface, a second back surface, a fourth front surface, a third back surface, and a fourth back surface. When the interleaf sheet number is three, the printing order is an order of a first front surface, a second front surface, a third front surface, a first back surface, a fourth front surface, a second back surface, a third back surface, and a fourth back surface. Even when duplex printing of four sheets or more is performed, the printing order is decided by the above principles (a) to (c).

Returning to the description of FIG. 4, when the print job represents an instruction for performing duplex printing, the printing order management unit 41 decides the printing order of the printing processes generated by the printing process management unit 40 according to the principle of the interleaf control described above and the interleaf sheet number stored in the interleaf sheet number storage unit 42. For example, when the print job represents an instruction for performing duplex printing on four sheets and the interleaf sheet number is two, on the above 8 printing processes, the printing order is decided as an order of a first front surface, a second front surface, a first back surface, a third front surface, a second back surface, a fourth front surface, a third back surface, and a fourth back surface. The interleaf sheet number storage unit 42 stores the interleaf sheet number. A value of the interleaf sheet number may be stored in advance, but since the sheet number for satisfying prescribed productivity may be different according to a difference in configuration of the image forming apparatus, for example, the value of the interleaf sheet number may appropriately change according to an administrator's operation via the operation panel.

The printing process execution control unit 50 controls each load so that the printing process requested from the printing process management unit 40 can be executed. Specifically, the printing process execution control unit 50 stores the printing process requested from the printing process management unit 40 in the printing process storage unit 62; queues the printing order queue 58; and requests the first conveyance control unit 51 to perform conveyance control of the sheet from a paper feeding position to the pre-transfer position so as to control execution of the printing process queued in the head of the printing order queue 58. The paper feeding position corresponding to a position of any one of the paper feed trays 9A, 9B, and 9C (a tray paper feeding position) in the case of the printing process for performing duplex printing; and corresponds to the duplex paper feeding position in the reverse-duplex path in the case of the printing process for performing back surface printing. Then, when the conveyance control from the paper feeding position to the pre-transfer position is finished, the printing process execution control unit 50 associates the printing process stored in the printing process storage unit 62 with a transfer conveyance flag; updates the printing order queue 58 by deleting the printing process from the printing order queue 58; and requests the second conveyance control unit 53 to perform conveyance control of the sheet from the pre-transfer position to the discharging position. The transfer conveyance flag refers to a flag representing that the conveyance from the paper feeding position of the sheet used in the printing process to the pre-transfer position has been finished. However, when the sheet is conveyed to the pre-transfer position, it is hereinafter assumed that the printing order of the sheet onto which the toner image is transferred at the transfer position does not change. Thus, as for the printing process associated with the transfer conveyance flag in the printing process storage unit 62, the printing order with the printing process of the next printing order is guaranteed.

The pre-feeding management unit 54 decides whether or not pre-feeding is to be executed on the printing process, which is subsequent to the printing process having an immediately previous printing order among the printing processes related to duplex printing queued in the printing order queue 58, using a predetermined pre-feeding condition; and control paper feeding timing according to the decision result. The pre-feeding represents that the sheet used in the printing process subsequent to the corresponding printing process is fed prior to the sheet used in the printing process having the immediately previous printing order at the time of duplex printing. A maximum number of sheets which can be precedingly fed (pre-fed) in the subsequent printing process are set in advance. The number of sheets is referred to as a pre-feeding setting sheet number. The pre-feeding setting sheet number is stored in the pre-feeding setting sheet number storage unit 59. The predetermined pre-feeding condition refers to the following conditions (A) to (C).

(A) A printing process having an immediately previous printing order performs back surface printing, and a printing process subsequent to the printing process performs surface printing.

(B) After a sheet used in a printing process having an immediately previous printing order is fed, if a sheet used in a printing process subsequent to the printing process is fed, specific conditions that lower productivity are as follows:

(B-1) a time taken for conveying the sheet from the duplex paper feeding position to the transfer position+a time taken for the conveyance of a first predetermined sheet interval distance<a time taken for conveying a sheet from the tray paper feeding position to the transfer position;

(B-1) a distance from the duplex paper feeding position to the transfer position+a first predetermined sheet interval distance<a distance from the tray paper feeding position to the transfer position; and (B-3) a paper feed tray, from which the sheet used in the subsequent printing process is fed, is a paper feed tray in which it takes a time to convey the sheet to the transfer position (referred to as a productivity decline tray).

(C) Charging is not performed in a paper feeding order of the sheet on printing.

In the condition (B), it is sufficient that at least one of (B-1) to (B-3) is satisfied. The pre-feeding management unit 54 may calculate (B-1) using the distance from the duplex paper feeding position to the transfer position and the speed at which the sheet is conveyed. The distance from the duplex paper feeding position to the transfer position may be set in advance and stored in a ROM or the like. The speed at which the sheet is conveyed may be calculated using the corresponding distance and the presence and absence of the sheet detected by a sensor disposed in the reverse-duplex path. The first predetermined sheet interval distance is a sheet interval for satisfying predetermined productivity and a distance not to bump into the rear end of the preceding sheet. At least one of a value of the predetermined sheet interval distance and a value of a time taken for the conveyance of the first predetermined sheet interval distance is set in advance and stored in a ROM. When this condition is applied, calculation is necessary; but it is possible to accurately the case in which productivity is lowered at the time of duplex printing, and robustness is high. (B-2) is based on the premise that the speed at which the sheet is conveyed from the duplex paper feeding position to the transfer position is equal to the speed at which the sheet is conveyed from the tray paper feeding position to the transfer position. When the two speeds are different, an error may possibly occur; but calculation is simplified compared to (B-1). As for (b-3) by setting at least one of the paper feed trays 9A, 9B, and 9C as the productivity decline tray in advance, the pre-feeding management unit 54 can determine whether or not the paper feed tray from which the sheet used in the printing process is fed is the paper feed tray set as the productivity decline tray in advance. For example, among the paper feed trays 9A, 9B, and 9C, the paper feed tray 9C which is farthest in the distance to the transfer position is set as the productivity decline tray in advance; and tray identification information for identifying the paper feed tray 9C is stored in a ROM or the like in advance. The condition (C) is given because when charging is performed on printing and when the balance is reduced in an order in which the sheet is fed from the paper feed tray 9, if the paper feeding order of the sheet changes due to execution of pre-feeding, there may be a shortage of the balance. For this reason, the printing order needs match with the paper feeding order of the sheet; and in this case, pre-feeding is not executed.

The paper feed tray from which the sheet used in each printing process is fed may be set in advance by the user's designation in the print job. When the printing process management unit 40 divides the print job into the printing processes, the paper feed tray may be set; or the printing process management unit 40 may set any one of the paper feed trays 9A, 9B, and 9C for every one sheet according to a predetermined setting method.

The pre-feeding management unit 54 determines whether or not the printing process related to duplex printing queued in the printing order queue 58 satisfies the predetermined pre-feeding condition; decides whether or not the pre-feeding is to perform; control paper feeding timing for feeding the sheet from the paper feeding position by executing the pre-feeding when it is decided that the pre-feeding is to perform; and controls the first conveyance control unit 51 such that the sheet is pre-fed. Specifically, the pre-feeding management unit 54 queues the printing process of pre-feeding the sheet in the pre-feeding order queue 61 which will be described later. In the case of executing pre-feeding of the sheet used in the printing process queued in the head of the pre-feeding order queue 61 by controlling the first conveyance control unit 51, the pre-feeding management unit 54 refers to the pre-fed sheet number stored in the pre-fed sheet number storage unit 60 which will be described later and the pre-feeding setting sheet number stored in the pre-feeding setting sheet number storage unit 59. At this time, when the pre-fed sheet number is smaller than the pre-feeding setting sheet number and a sheet interval with a sheet precedingly conveyed from the paper feed tray 9 is a second predetermined sheet interval distance or more, by controlling the first conveyance control unit 51 and feeding the sheet used in the corresponding printing process from the tray paper feeding position, the pre-feeding management unit 54 pre-feeds the corresponding sheet. The second predetermined sheet interval distance refers to a distance at which a paper jam is not caused, that is, a distance at which a preceding sheet does not bump into a subsequent sheet. The second predetermined sheet interval distance is set in advance. Thereafter, the pre-feeding management unit 54 increases the pre-fed sheet number by one; updates the pre-fed sheet number stored in the pre-fed sheet number storage unit 60; and update the pre-feeding order queue 61 by deleting the corresponding printing process from the pre-feeding order queue 61. Further, when the pre-fed sheet reaches the re-feed position, the pre-feeding management unit 54 controls the re-feed position control unit 52 according to the printing order of the printing process using the corresponding sheet and the sheet interval between the pre-fed sheet and the sheet precedent to the corresponding sheet such that the corresponding sheet is on standby at the re-feed position or the corresponding sheet is fed from the re-feed position. Further, when a printing process having a printing order immediately next to a printing process using the sheet fed from the duplex paper feeding position is for performing front surface printing and the pre-fed sheet number stored in the pre-fed sheet number storage unit 60 is one or more, the pre-feeding management unit 54 decreases the pre-fed sheet number by one and updates the pre-fed sheet number stored in the pre-fed sheet number storage unit 60.

The pre-fed sheet number storage unit 60 stores the pre-fed sheet number which is the number of pre-fed sheets. The pre-feeding order queue 61 queues the printing process under control of the pre-feeding management unit 54. The pre-feeding setting sheet number storage unit 59 stores the pre-feeding setting sheet number. A value of the pre-feeding setting sheet number is set in advance but may appropriately change, for example, according to the administrator's operation via the operation panel.

Figure 6:
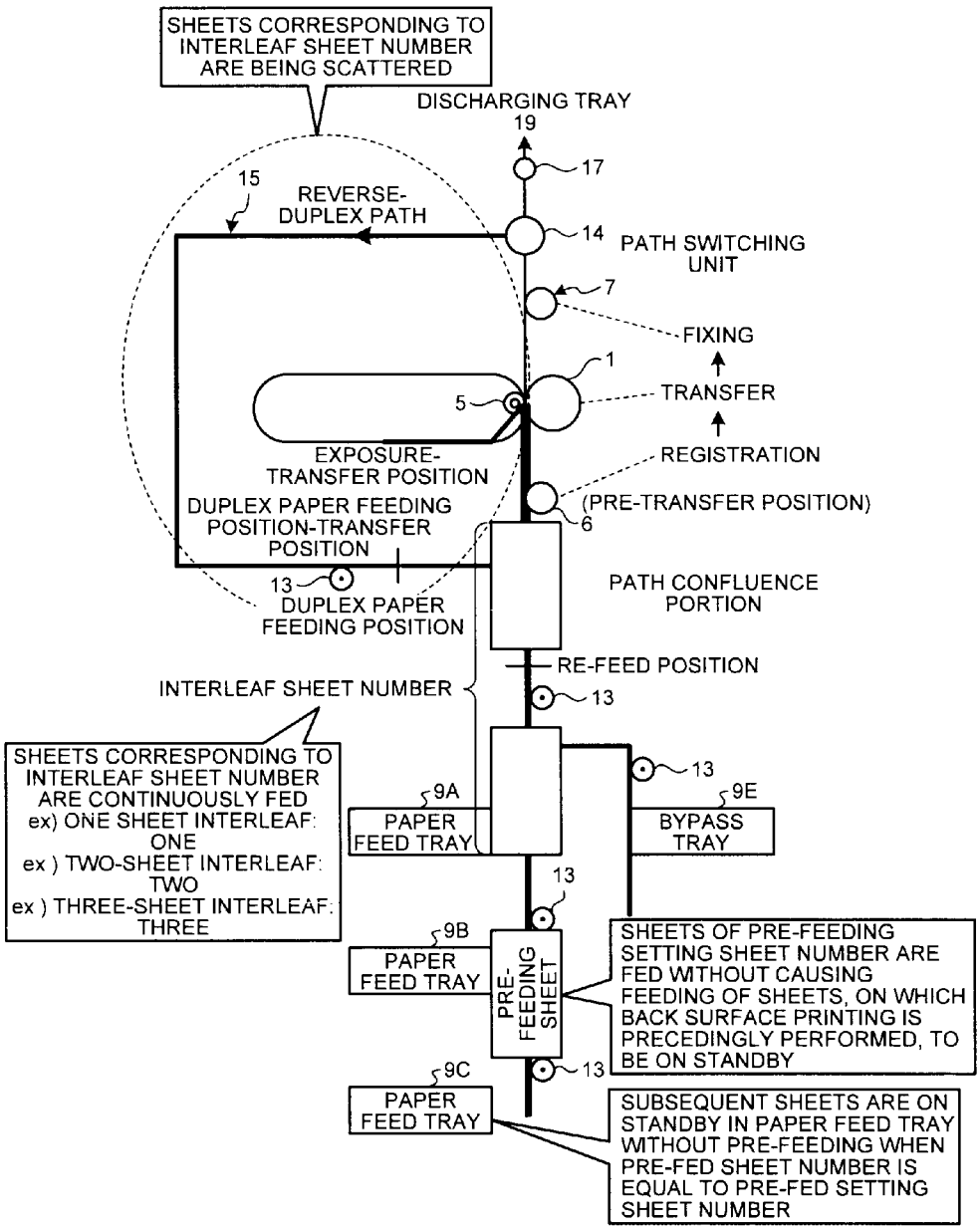
FIG. 6 is a diagram illustrating an overview of a state of a conveying path when pre-feeding is executed at the time of duplex printing.

An overview of a state of the conveying path when the pre-feeding is executed at the time of duplex printing will be described with reference to FIG. 6. In duplex printing, first the sheets of the target on which front surface printing is performed are continuously fed from the paper feed tray 9 according to the interleaf sheet number and continuously subjected to printing; and the printed sheets are scattered on the reverse-duplex path according to the interleaf sheet number. The sheets having reached the duplex paper feeding position are conveyed to the pre-transfer position in order and then conveyed to the transfer position; and back surface printing is performed. However, in the present embodiment, the engine control unit 32 causes new sheets on which front surface printing is to be performed after back surface printing to be precedingly continuously fed from the paper feed tray 9 by the pre-feeding setting sheet number before the sheet on which back surface printing is precedingly performed is conveyed from the duplex paper feeding position to the pre-transfer position. As a result, sheets of "interleaf sheet number+pre-feeding setting sheet number" are fed into the conveying path of the image forming apparatus.

Returning to the description of FIG. 4, the first conveyance control unit 51 controls the paper jam prevention interval management unit 55 in response to a request from the printing process execution control unit 50 under control of the pre-feeding management unit 54 and controls the conveyance of the sheet from the paper feeding position to the pre-transfer position. Specifically, the first conveyance control unit 51 controls driving and the suspension of driving of the paper feeding rollers 12 and 13 included in the paper feed tray 9 and the paper feeding roller 13 arranged in the vicinity of the duplex paper feeding position. Further, the first conveyance control unit 51 detects whether or not the sheet has reached the vicinity of the duplex paper feeding position in the reverse-duplex path based on a detection result of a sensor disposed in the vicinity of the duplex paper feeding position. The re-feed position control unit 52 controls driving and the suspension of driving of the paper feeding roller 13 arranged in the vicinity of the re-feed position under control of the pre-feeding management unit 54 so as to control a standby at the re-feed position of the sheet fed from the paper feed tray 9 and pre-fed and the conveyance via the re-feed position. The second conveyance control unit 53 controls the transfer position alignment timing adjustment unit 57 and the productivity interval management unit 56 in response to a request from the printing process execution control unit 50 and controls the conveyance of the sheet from the pre-transfer position to the discharging position. Specifically, by controlling the transfer position alignment timing adjustment unit 57 and the productivity interval management unit 56, the second conveyance control unit 53 controls driving and the suspension of driving of the registration roller 6 and controls the conveyance to the transfer roller 5, the fixing unit 7, and the bifurcating claw 14 and switching of the bifurcating claw 14. At the time of duplex printing, the second conveyance control unit 53 switches the sheet having undergone front surface printing; reverse the corresponding sheet; conveys the reversed sheet to the duplex paper feeding position; switches the sheet having undergone back surface printing to the discharging roller through the bifurcating claw 14; and discharges the corresponding sheet to the discharge tray 19 through the discharging roller 17.

The transfer position alignment timing adjustment unit 57 adjusts the position alignment between the transfer of the toner image and the sheet at the transfer position, and drives the registration roller 6 under control of the second conveyance control unit 53. The paper jam prevention interval management unit 55 detects whether or not a sheet interval with the sheet precedingly conveyed from the paper feeding position to the pre-transfer position is the second predetermined sheet interval distance or more under control of the first conveyance control unit 51. Specifically, the paper jam prevention interval management unit 55 calculates the sheet interval between the preceding sheet and the subsequent sheet based on the presence and absence of the sheet which is detected by a sensor disposed in the conveying path between the paper feeding position and the pre-transfer position and the speed at which the sheet is conveyed by the paper feeding roller 13; and performs the above-described detection by comparing the sheet interval with the second predetermined sheet interval distance. The productivity interval management unit 56 detects whether or not a sheet interval with the sheet precedingly conveyed from the pre-transfer position to the discharging position is the first predetermined sheet interval distance or more under control of the second conveyance control unit 53. Specifically, the productivity interval management unit 56 calculates the sheet interval between the preceding sheet and the subsequent sheet based on the presence and absence of the sheet detected by a sensor disposed in the vicinity of the pre-transfer position and the speed at which the sheet is conveyed by the registration roller 6; and performs the above-described detection by comparing the sheet interval with the first predetermined sheet interval distance.

A first decision unit is implemented by the printing order management unit 41 described above. An execution control unit is implemented by the printing process execution control unit 50. A first sheet feeding control unit is implemented by all or some of the printing process execution control unit 50, the first conveyance control unit 51, and the second conveyance control unit 53. A second paper feeding control unit is implemented by all or some of the printing process execution control unit 50, the first conveyance control unit 51, and the second conveyance control unit 53. A third paper feeding control unit is implemented by the re-feed position control unit 52. A second decision unit is implemented by the pre-feeding management unit 54.

Figure 7:
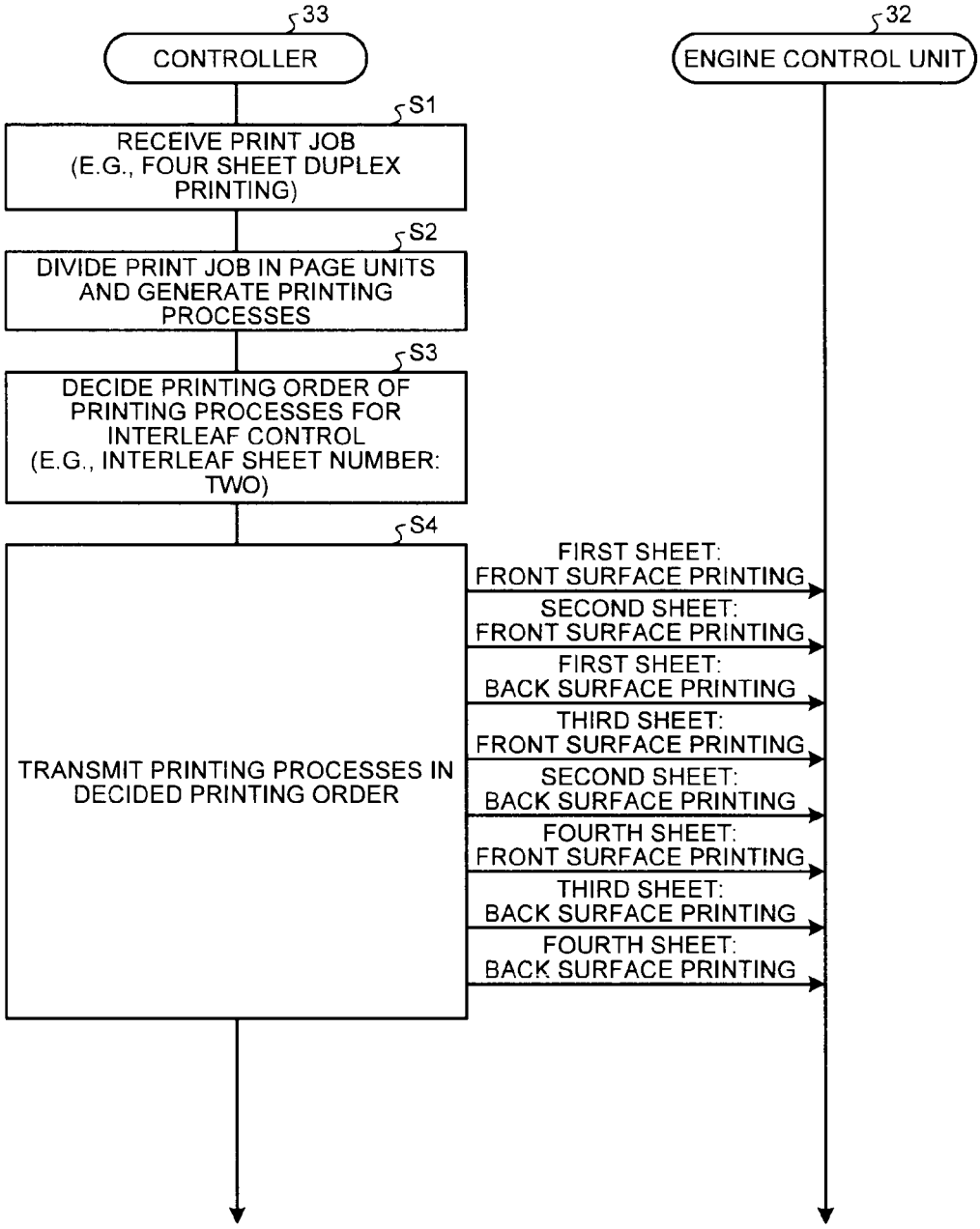
FIG. 7 is a flowchart illustrating an overview of a procedure of a process of receiving a print job and performing interleaf control through an image forming apparatus.

Next, a description will be made in connection with a procedure of a process performed by the image forming apparatus according to the present embodiment. First, an overview of a procedure of a process of receiving a print job and performing interleaf control through an image forming apparatus will be described with reference to FIG. 7. In step S1, the controller 33 of the image forming apparatus receives a print job related to duplex printing in response to printing instruction data and an operation input from a user; and then in step S2, the controller 33 of the image forming apparatus divides the print job into printing processes of page units and generates the printing processes through the function of the printing process management unit 40. Then, in step S3, through the function of the printing order management unit 41, the controller 33 decides the printing order of the printing processes generated in step S2 according to the principle of the interleaf control and the interleaf sheet number stored in the interleaf sheet number storage unit 42. Then, in step S4, through the function of the printing process management unit 40, the controller 33 transmits the printing processes generated in step S2 to the engine control unit 32 in the printing order decided in step S3 and requests the engine control unit 32 to execute the printing processes. Specifically, for example, when the print job represents an instruction for performing duplex printing on four sheets, transmitted to the engine control unit 32 are eight printing processes including first front surface printing, second front surface printing, first back surface printing, third front surface printing, second back surface printing, fourth front surface printing, third back surface printing, and fourth back surface printing.

Next, a procedure of a process of executing the generated printing processes through the image forming apparatus will be described with reference to FIG. 8. In step S10, through the function of the printing process execution control unit 50, the engine control unit 32 of the image forming apparatus stores the printing processes received from the controller 33 in the printing process storage unit 62 and queues the printing processes in the printing order queue 58. In step S11, the engine control unit 32 determines whether or not the printing process queued in the head of the printing order queue 58 is the process for performing front surface printing. When the determination result is positive (Yes in step S11), in step S12, the engine control unit 32 performs a pre-feeding execution determination process through the function of the pre-feeding management unit 54.

Figure 9:
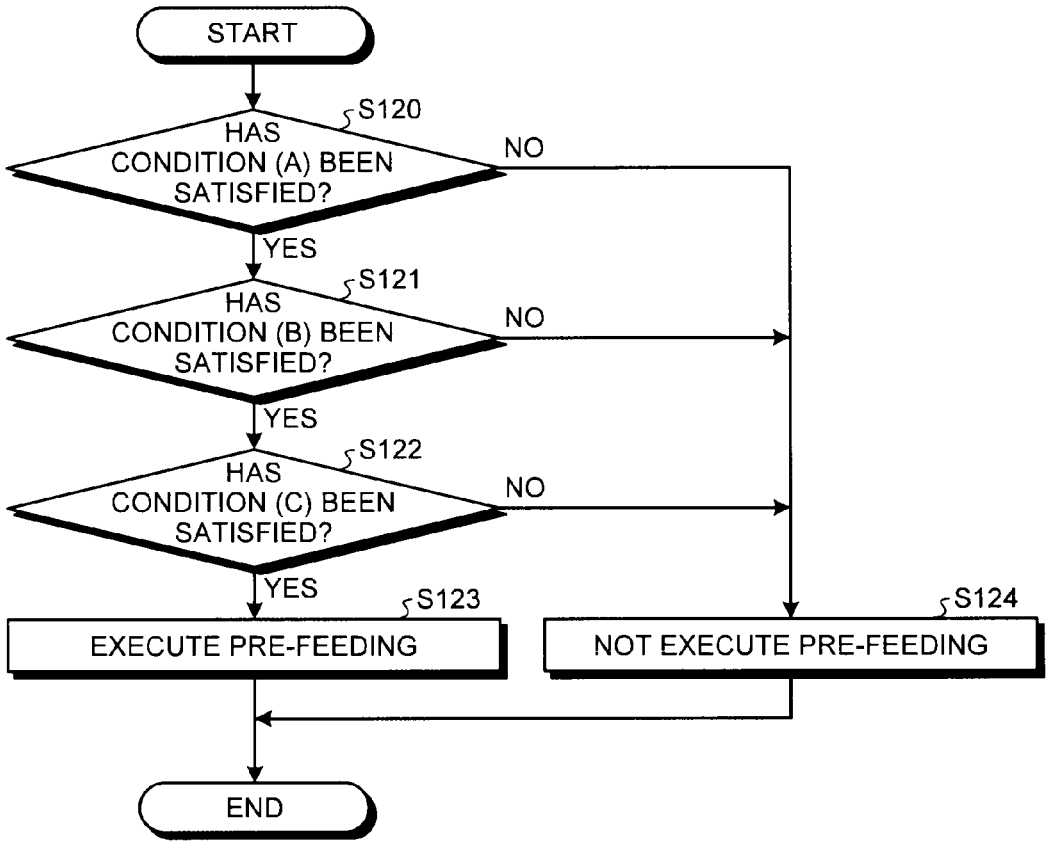
FIG. 9 is a flowchart illustrating a detailed procedure of a pre-feeding execution determination process.

A detailed procedure of the pre-feeding execution determination process of step S12 will be described with reference to FIG. 9. In step S120, the engine control unit 32 determines whether or not the condition A among the above described predetermined pre-feeding condition is satisfied through the function of the pre-feeding management unit 54. When the determination result is negative (No in step S120), the process proceeds to step S124. However, when the determination result is positive (Yes in step S120), in step S121, the engine control unit 32 determines whether or not the condition B among the above described predetermined pre-feeding condition is satisfied. When the determination result is negative (No in step S121), the process proceeds to step S124. However, when the determination result is positive (Yes in step S121), in step S122, the engine control unit 32 determines whether or not the condition C among the above described predetermined pre-feeding condition is satisfied. When the determination result is negative (No in step S122), the process proceeds to step S124. However, when the determination result is positive (Yes in step S122), in step S123, the engine control unit 32 determines that the pre-feeding is to execute. Meanwhile, in step S124, the engine control unit 32 decides that the pre-feeding is not to execute.

Figure 8:
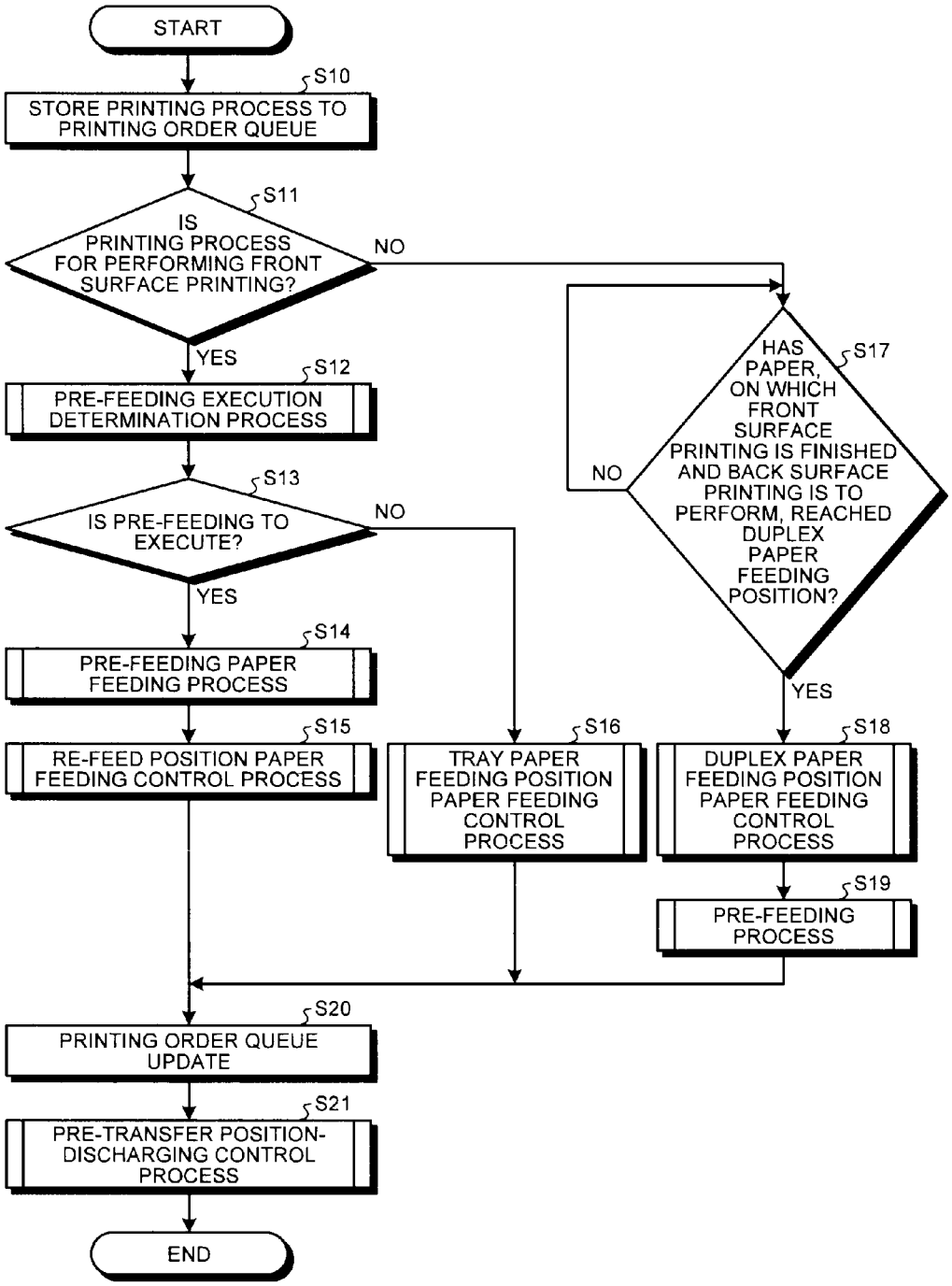
FIG. 8 is a flowchart illustrating a procedure of a process of executing generated printing processes through an image forming apparatus.

Returning to the description of FIG. 8, when it is decided in step S13 that the pre-feeding is to execute (Yes in step S13), in step S14, the engine control unit 32 performs a pre-feeding paper feeding process. However, when it is decided in step S13 that the pre-feeding is not to execute, in step S16, the engine control unit 32 performs a tray paper feeding position paper feeding control process.

Figure 10:
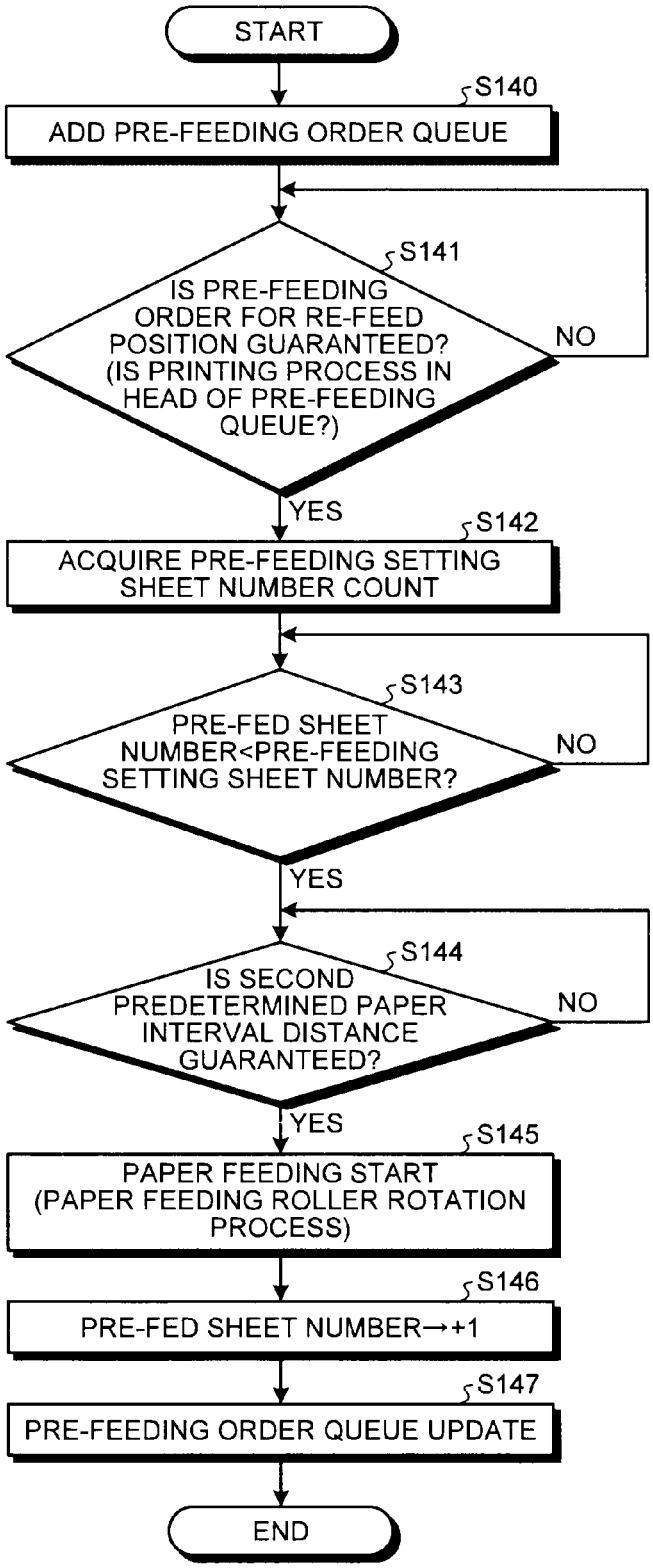
FIG. 10 is a flowchart illustrating a detailed procedure of a pre-feeding paper feeding process.

A detailed procedure of the pre-feeding paper feeding process of step S14 will be described with reference to FIG. 10. In step S140, through the function of the pre-feeding management unit 54, the engine control unit 32 queues the printing processes in which the sheet is pre-fed in the pre-feeding order queue 61. When there is a printing process queued in the head of the pre-feeding order queue 61 (Yes in step S141), the engine control unit 32 refers to the pre-fed sheet number stored in the pre-fed sheet number storage unit 60 in step S142; compares the pre-fed sheet number with the pre-feeding setting sheet number stored in the pre-feeding setting sheet number storage unit 59; and determines whether or not the pre-fed sheet number is smaller than the pre-feeding setting number in step S143. When the determination result is negative (No in step S143), since a maximum number of sheets which can be pre-fed has been already pre-fed, the process returns to step S143, and execution of pre-feeding is on standby until the pre-fed sheet number becomes smaller than the pre-feeding setting sheet number. However, when the determination result is positive (Yes in step S143), in step S144, through the function of the paper jam prevention interval management unit 55, the engine control unit 32 detects whether or not the sheet interval with the precedingly fed sheet is the second predetermined sheet interval distance or more. When the sheet interval is smaller than the second predetermined sheet interval distance (No in step S144), the process returns to step S144. However, when the sheet interval is the second predetermined sheet interval distance or more (Yes in step S144), in step S145, through the function of the first conveyance control unit 51, the engine control unit 32 pre-feeds the corresponding sheet by driving the paper feeding roller 13 of the paper feed tray 9 from which the sheet used in the printing process is fed and feeding the corresponding sheet from the tray paper feeding position. Through execution of the pre-feeding, on the printing process of performing front surface printing in duplex printing, the sheets are conveyed to the re-feed position in the printing order. Thus, in step S146, through the function of the pre-feeding management unit 54, the engine control unit 32 increases the pre-fed sheet number by one and updates the pre-fed sheet number stared in the pre-fed sheet number storage unit 60. Further, in step S147, the engine control unit 32 deletes the corresponding printing process from the pre-feeding order queue 61 and updates the pre-feeding order queue 61. As a result, a new printing process queued in the head of the pre-feeding order queue 61 becomes a next pre-feeding target, and the paper feeding order of the sheet is guaranteed.

Returning to the description of FIG. 8, after processing of step S14, in step S15, the engine control unit 32 performs a re-feed position paper feeding control process. A detailed procedure of the re-feed position paper feeding control process of step S15 will be described with reference to FIG. 11. In step S150, through the function of the first conveyance control unit 51, the engine control unit 32 determines whether or not the sheet pre-fed in step S14 has reached the re-feed position. For example, when the sheet is detected by a sensor disposed in the vicinity of the re-feed position, the engine control unit 32 determines that the sheet has reached the re-feed position. When the determination result of step S150 is positive (Yes in step S150), in step S151, the engine control unit 32 determines whether the printing order is guaranteed even thought the sheet is conveyed to the pre-transfer position through the function of the pre-feeding management unit 54. Specifically, when the transfer conveyance flag in the printing process storage unit 62 is associated with the printing process, in the printing order queue 58, which has the printing order immediately precedent to the printing process using the corresponding sheet, since the sheet used in the printing process having the immediately previous printing order has been already conveyed to the pre-transfer position, even though the sheet used in the subsequent printing process is conveyed to the pre-transfer position, the printing order of the printing process does not change but is guaranteed. Thus, in this case, the determination result of step S151 is positive, and the process proceeds to step S153. However, the transfer conveyance flag in the printing process storage unit 62 is not associated with the printing process, in the printing order queue 58, which has the printing order immediately precedent to the printing process using the corresponding sheet, since the sheet used in the printing process having the immediately previous printing order has not been conveyed to the pre-transfer position yet, if the sheet used in the subsequent printing process is precedingly conveyed to the pre-transfer position, the printing order of the printing process may possibly change and thus is not guaranteed. For this reason, in this case, the determination result of step S151 is negative. In step S152, through the function of the re-feed position control unit 52, the engine control unit 32 suspends driving of the paper feeding roller 13 arranged in the vicinity of the re-feed position so as to cause the sheet having reached the re-feed position to be on standby at the re-feed position. Here, when control of measuring conveyance timing of the sheet by measurement of a time, the engine control unit 32 temporarily stops measurement of a time. Thereafter, the process returns to step S151.

In step S153, through the function of the paper jam prevention interval management unit 55, the engine control unit 32 detects whether or not the sheet interval with the sheet precedingly conveyed from the re-feed position to the pre-transfer position is the second predetermined sheet interval distance or more. When the determination result is negative (No in step S153), in step S154, similarly to step S152, through the function of the re-feed position control unit 52, the engine control unit 32 causes the sheet having reached the re-feed position to be on standby at the re-feed position, and the process returns to step S153. However, when the determination result is positive (Yes in step S153), in step S155, the engine control unit 32 determines whether or not the sheet having reached the re-feed position has been on standby at the re-feed position. When the determination result is positive (Yes in step S155), in step S156, through the function of the re-feed position control unit 52, the engine control unit 32 causes the sheet to be fed from the re-feed position by starting driving of the paper feeding roller 13 arranged in the vicinity of the re-feed position so as to release the standby of the sheet present at the re-feed position. Here, when control of measuring conveyance timing of the sheet by measurement of a time, the engine control unit 32 restarts measurement of a time which has been suspended in step S152 or step S154 and feeds the corresponding sheet from the re-feed position by starting driving of the paper feeding roller 13 arranged in the vicinity of the re-feed position in response to the measurement. Even though the determination result of step S155 is negative, the corresponding paper present at the re-feed position is conveyed.

Figure 12:
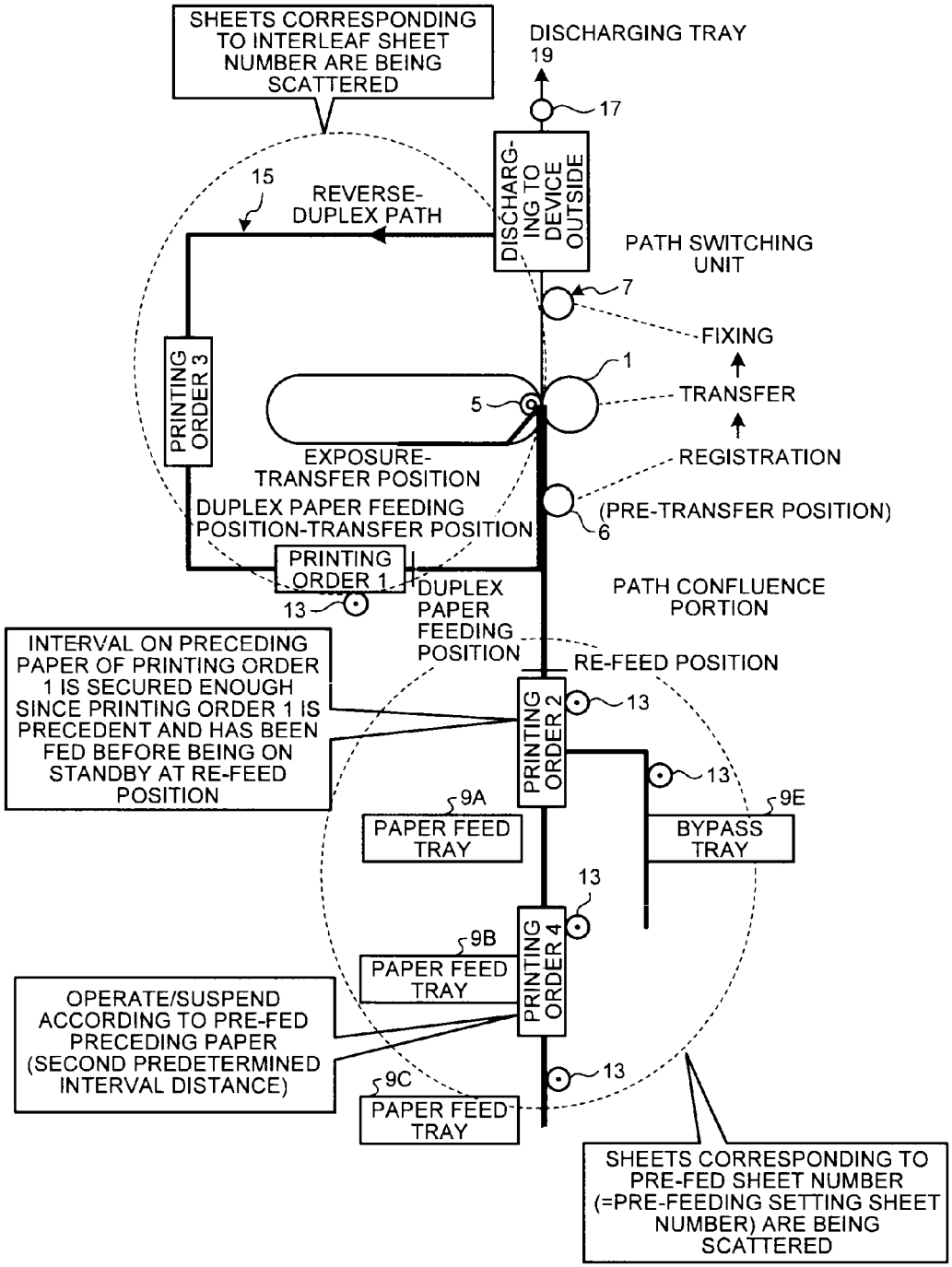
FIG. 12 is a diagram illustrating an overview of a state of a conveying path when a re-feed position paper feeding control process is performed.
Figure 13:
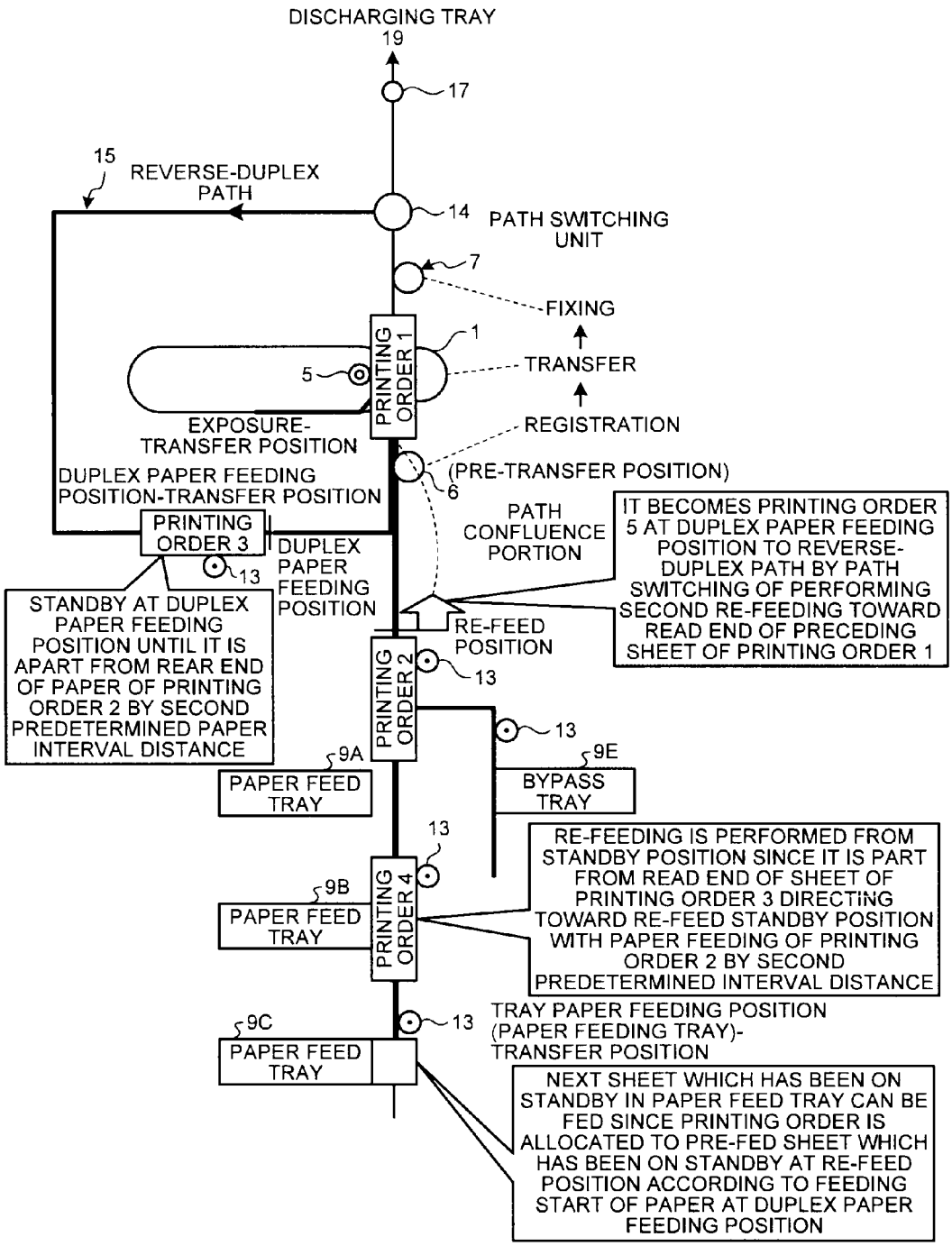
FIG. 13 is a diagram illustrating an overview of a state of a conveying path when a re-feed position paper feeding control process is performed.

An overview of a state of the conveying path when the re-feed position paper feeding control process is performed will be described with reference to FIGS. 12 and 13. Let us assume that the printing order of the printing process using the sheet (the printing order 1) having reached the re-feed position illustrated in FIG. 12 is second; and the printing order of the printing process of performing back surface printing using the sheet (a printing order 2) present at the duplex paper feeding position is first. In this case, since the first printing process is precedent, the sheet (the printing order 2) used in the second printing process is on standby at the re-feed position as in step S152 of FIG. 11. In addition, when there is a paper pre-fed subsequent to the corresponding sheet, the sheet is on standby according to the standby of the sheet of the printing order 2. Here, since the sheet is fed from the paper feed tray 9 such that the sheet interval between the preceding sheet and the subsequent sheet is the second predetermined sheet interval distance or more, the subsequent sheet does not bump into the preceding sheet.

Figure 11:
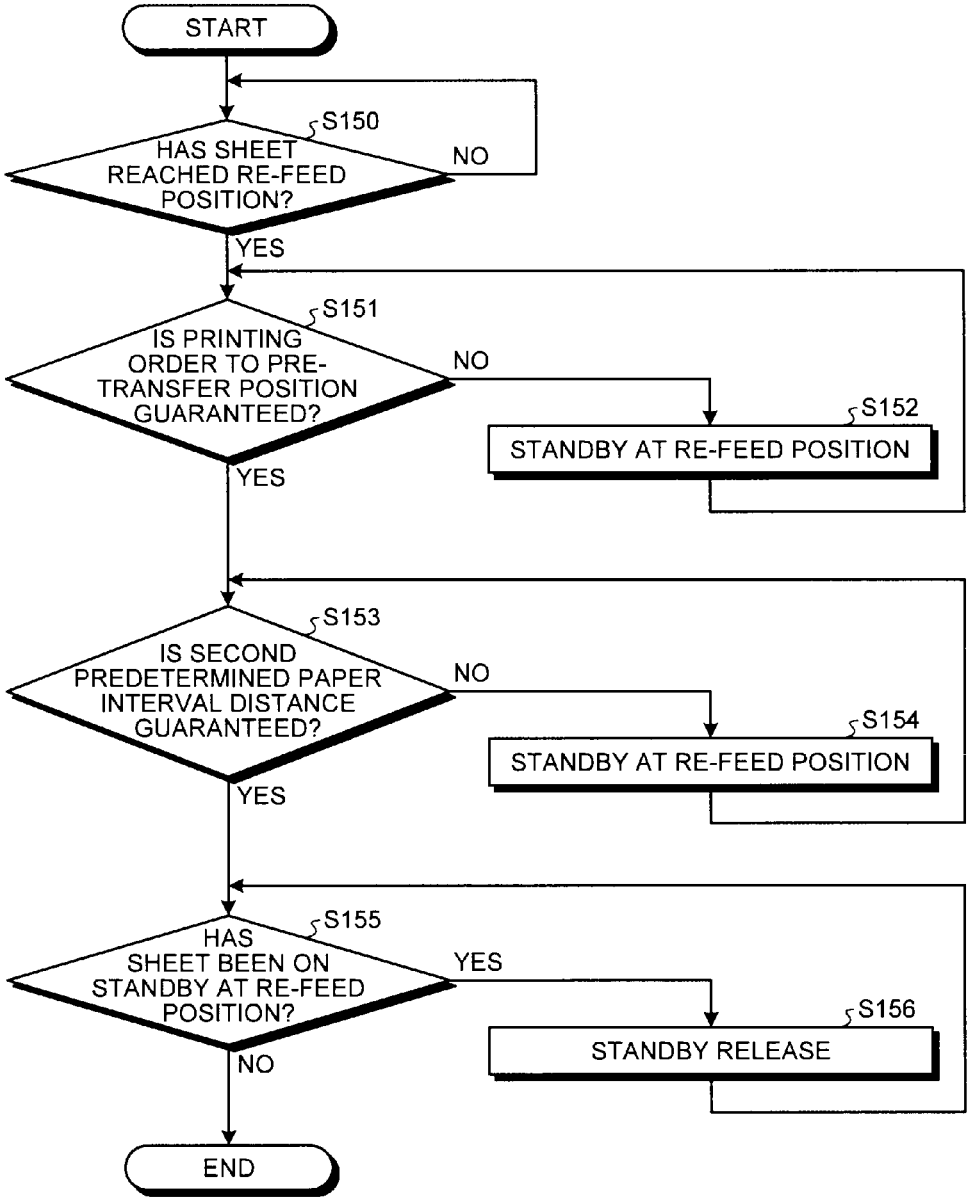
FIG. 11 is a flowchart illustrating a detailed procedure of a re-feed position paper feeding control process.

Then, after the sheet (the printing order 1) of the target on which back surface printing is precedingly performed is directed from the duplex paper feeding position toward the transfer position, the determination result of step S151 of FIG. 11 becomes positive. Further, when the front end of the sheet (the printing order 2) that has been on standby at the re-feed position has an interval not to bump into the rear end of the sheet of the printing order 1, that is, when the paper interval between the sheet of the printing order 2 and the sheet of the printing order 1 has become the second predetermined sheet interval distance or more, as illustrated in FIG. 13, paper feeding from the re-feed position starts. As a result, the sheet of the printing order 2 which is on standby at the re-feed position does not bump into the sheet of the printing order 1; and it is possible to perform front surface printing on the sheet of the printing order 2 (actually, the sheet used in the printing process whose printing order has ascended from the second to the first) without expending a time after back surface printing on the sheet of the printing order 1 is finished. That is, since the interval between the sheet of the target on which back surface printing is performed and a new sheet of the target on which front surface printing is performed after back surface printing can be reduced compared to the conventional art, a decrease in productivity at the time of duplex printing can be suppressed.

Here, with the feeding of the sheet of the printing order 2 from the re-feed position, the conveyance of the sheet which has been on standby according to the standby of the sheet of the printing order 2 and subsequently pre-fed also starts. Then, when the sheet which has been subsequently pre-fed reaches the re-feed position, the state of FIG. 12 is returned. Further, at a point in time when the sheet of the target of the printing order 1 on which back surface printing is performed is directed from the duplex paper feeding position to the transfer position, there disappears precedence of the sheet which has been pre-fed and on standby at the re-feed position with respect to the sheet used in the printing process of performing back surface printing in which the printing order is first. For this reason, it is possible to newly pre-feed the sheet from the paper feed tray 9 so as to secure precedence with respect to the sheet used in the printing process of performing new back surface printing (in FIG. 12, the printing process in which the printing order is third).

Returning to the description of FIG. 8, after processing of step S15, the engine control unit 32 proceeds to step S20.

Next, a detailed procedure of the tray paper feeding position paper feeding control process of step S16 will be described with reference to FIG. 14. In step S160, the engine control unit 32 determines whether or not the printing order is guaranteed even though the sheet is conveyed from the paper feed tray 9 to the pre-transfer position through the function of the pre-feeding management unit 54. Here, let us assume that from which one of the paper feed trays 9A, 9B, and 9C the sheet is conveyed is set as described above. Specifically, similarly to step S151, the engine control unit 32 perform the determination based on whether or not the transfer conveyance flag in the printing process storage unit 62 is associated with the printing process, in the printing order queue 58, which has the printing order immediately precedent to the printing process using the corresponding sheet. When the determination result is negative (No in step S160), the process returns to step S160. However, when the determination result is positive (Yes in step S160), in step S161, through the function of the paper jam prevention interval management unit 55, the engine control unit 32 detects whether or not the sheet interval with the sheet precedingly conveyed from the re-feed position to the pre-transfer position is the second predetermined sheet interval distance or more. When the determination result is negative (No in step S161), the process returns to step S161. However, when the determination result is negative (Yes in step S161), in step S162, the engine control unit 32 feeds the sheet from the paper feed tray 9 through the function of the first conveyance control unit 51.

Returning to the description of FIG. 8, after processing of step S16, the engine control unit 32 proceeds to step S20. Meanwhile, when the determination result of step S11 is negative (No in step S11), it means that the printing process queued in the head of the printing order queue 58 is for performing back surface printing. In this case, in step S17, the engine control unit 32 detects whether or not the sheet used in the corresponding printing process has reached the duplex paper feeding position through the function of the first conveyance control unit 51. When the determination result is negative (No in step S17), the process returns to step S17. However, when the determination result is negative (Yes in step S17), in step S18, the engine control unit 32 performs a duplex paper feeding position paper feeding control process.

A detailed procedure of the duplex paper feeding position paper feeding control process of step S18 will be described with reference to FIG. 15. In step S180, the engine control unit 32 determines whether or not the printing order is guaranteed even though the sheet is conveyed from the duplex paper feeding position to the pre-transfer position through the function of the pre-feeding management unit 54. Specifically, similarly to step S151, the engine control unit 32 perform the determination based on whether or not the transfer conveyance flag in the printing process storage unit 62 is associated with the printing process, in the printing order queue 58, which has the printing order immediately precedent to the printing process using the corresponding sheet. When the determination result is negative (No in step S180), in step S181, the engine control unit 32 suspends driving of the paper feeding roller 13 arranged in the vicinity of the duplex paper feeding position so as to cause the paper having reached the duplex paper feeding position to be on standby at the duplex paper feeding position. Here, when control of measuring conveyance timing of the sheet by measurement of a time, the engine control unit 32 temporarily suspends measurement of a time. Thereafter, the process returns to step S180. However, when the determination result is positive (Yes in step S180), in step S182, through the function of the paper jam prevention interval management unit 55, the engine control unit 32 detects whether or not the sheet interval with the sheet precedingly conveyed from the duplex paper feeding position to the pre-transfer position is the second predetermined sheet interval distance or more. When the determination result is negative (No in step S182), in step S183, similarly to step S181, through the function of the first conveyance control unit 51, the engine control unit 32 causes the sheet having reached the duplex paper feeding position to be on standby at the duplex paper feeding position, and the process returns to step S182. However, when the determination result is positive (Yes in step S182), in step S184, the engine control unit 32 determines whether or not the sheet having reached the duplex paper feeding position has been on standby at the duplex paper feeding position. When the determination result is positive (Yes in step S184), in step S185, through the function of the first conveyance control unit 51, the engine control unit 32 causes the sheet to be fed from the duplex paper feeding position by starting driving of the paper feeding roller 13 arranged in the vicinity of the duplex paper feeding position so as to release the standby of the paper present at the duplex paper feeding position. Here, when control of measuring conveyance timing of the sheet by measurement of a time, the engine control unit 32 restarts measurement of a time which has been suspended in step S181 or step S183 and feeds the corresponding sheet from the duplex paper feeding position by starting driving of the paper feeding roller 13 arranged in the vicinity of the duplex paper feeding position in response to the measurement. Even though the determination result of step S184 is negative, the corresponding sheet present at the duplex paper feeding position is conveyed.

Figure 16:
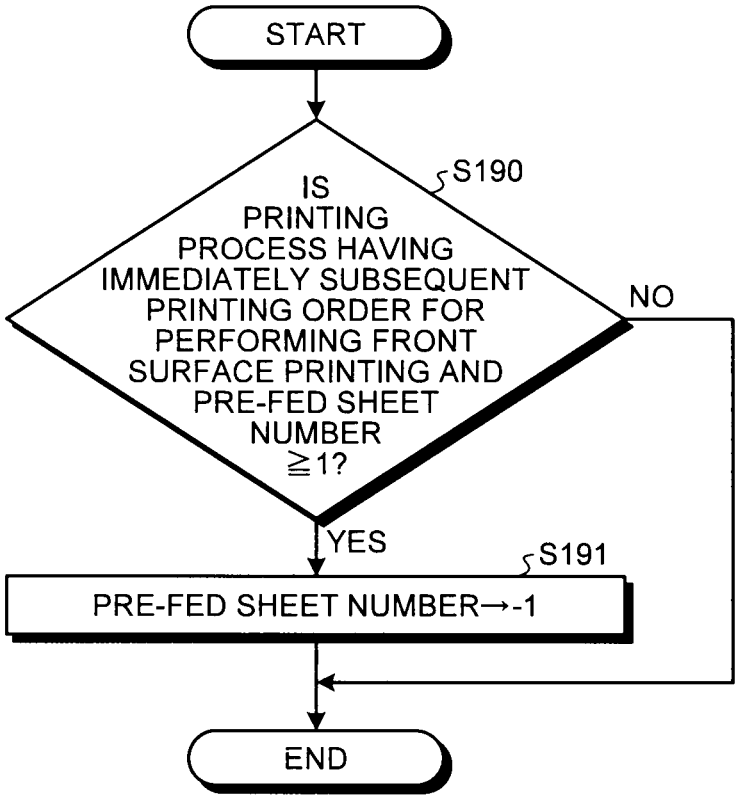
FIG. 16 is a flowchart illustrating a procedure of a detailed process of a pre-feeding process.

Returning to the description of FIG. 8, after processing of step S18, in step S19, the engine control unit 32 performs a pre-feeding process. A detailed procedure of a pre-feeding process of step S19 will be described with reference to FIG. 16. In step S190, through the function of the pre-feeding management unit 54, the engine control unit 32 refers to the printing process storage unit 62 and determines whether or not the printing process having a printing order immediately next to the printing process using the sheet fed from the duplex paper feeding position in step S18 of FIG. 8 is for performing front surface printing and the pre-fed sheet number stored in the pre-fed sheet number storage unit 60 is one or more. When the determination result is positive (Yes in step S190), in step S191, the engine control unit 32 decreases the pre-fed sheet number by one and updates the pre-fed sheet number stored in the pre-fed sheet number storage unit 60. Through this process, the sheet which has been on standby to execute the pre-feeding in step S143 of FIG. 10 can be pre-fed. That is, at a point in time when the sheet used in the printing process of precedingly performing back surface printing is fed from the duplex paper feeding position, the printing process using the sheet in the head in the conveying path to the pre-transfer position among the sheets which are used in the printing process having the printing order next to the corresponding printing process and have been pre-fed becomes a next printing order.

Meanwhile, when the printing process having a printing order immediately precedent to the printing process using the sheet fed from the duplex paper feeding position in step S18 of FIG. 8 is not for performing back surface printing after front surface printing is completed (No in step S19) or when it is not the target of execution of pre-feeding but the pre-fed sheet number stored in the pre-fed sheet number storage unit 60 is zero (0) (No in step S190), since the pre-fed sheet is not present and it is not necessary to update the pre-fed sheet number, the engine control unit 32 finishes the process.

Returning to the description of FIG. 8, after processing of step S19, the engine control unit 32 proceeds to step S20. In step S20, when conveyance control from the paper feeding position to the pre-transfer position is finished and the sheet reaches the pre-transfer position, in step S20, through the function of the printing process execution control unit 50, the engine control unit 32 updates the printing order queue 58 by associating the transfer conveyance flag with the printing process which is stored in the printing process storage unit 62 and uses the corresponding sheet and deleting the corresponding printing process from the printing order queue 58. As a result, a new printing process queued in the head of the printing order queue 58 becomes an execution target of a next printing order, and the printing order is guaranteed.

Figure 17:
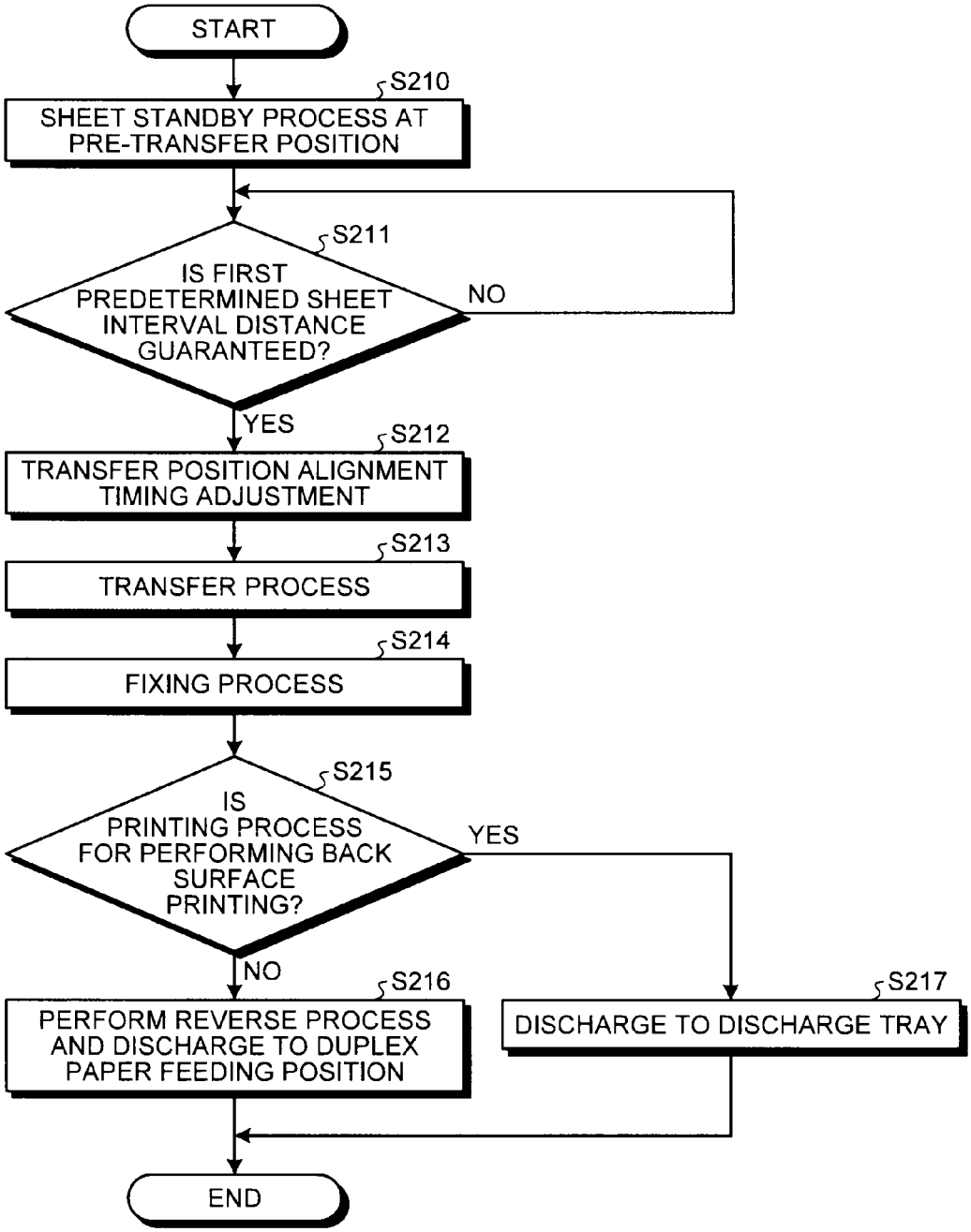
FIG. 17 is a flowchart illustrating a procedure of a detailed process of a pre-transfer position-paper discharging control process.

Then, in step S21, the engine control unit 32 performs a pre-transfer position-paper discharging control process through the function of the second conveyance control unit. A detailed procedure of the pre-transfer position-paper discharging control process of step S21 will be described with reference to FIG. 17. In step S210, through the function of the second conveyance control unit 53, the engine control unit 32 suspends driving of the registration roller 6 and causes the sheet to be on standby at the pre-transfer position. Then, in step S211, through the function of the productivity interval management unit 56, the engine control unit 32 detects whether or not the sheet interval is the first predetermined sheet interval distance or more. When the determination result is negative (No in step S211), the process returns to step S211. However, when the determination result is positive (Yes in step S211), in step S212, through the function of the transfer position alignment timing adjustment unit 57, the engine control unit 32 adjust the position alignment between the transfer of the toner image and the sheet at the transfer position; drives the registration roller 6; and conveys the sheet to the transfer position. Next, in step S213, the engine control unit 32 transfers the toner image on the photosensitive element 1 onto the corresponding sheet through the transfer roller 5. The corresponding sheet is conveyed to the fixing unit 7. In step S214, the toner image is fixed onto the corresponding sheet through the fixing unit 7. The corresponding sheet is conveyed to the bifurcating claw 14. Then, in step S215, the engine control unit 32 determines whether or not the printing process using the corresponding sheet is for performing back surface printing by referring to the printing process storage unit 62. When the determination result is positive (Yes in step S215), in step S217, through the function of the second conveyance control unit 53, the engine control unit 32 switches the bifurcating claw 14 to the discharging roller 17 side and discharges the corresponding sheet to the discharge tray 19 through the discharging roller 17. When the determination result of step S215 is negative (No in step S215), in step S216, through the function of the second conveyance control unit 53, the engine control unit 32 switches the bifurcating claw 14 to the reverse-duplex path side; reverses the corresponding sheet; and conveys the reversed sheet to the duplex paper feeding position. The engine control unit 32 performs the above described process on all printing processes queued in the printing order queue 58.

As described above, the image forming apparatus feeds the sheet of the target on which front surface printing is subsequently performed from the tray paper feeding position, pre-feeds the sheet, and causes the pre-fed sheet to be appropriately on standby at the re-feed position before feeding the sheet of the target on which back surface printing is precedingly performed regardless of the interleaf sheet number and the implementation of the interleaf control at the time of duplex printing. Thus, it is possible to reduce the interval between the preceding sheet and the subsequent sheet while keeping the printing order at the time of duplex printing, and it is possible to suppress a decrease in productivity at the time of duplex printing. Further, when the sheet is pre-fed, the image forming apparatus performs control such that pre-feeding is performed while keeping the distance not to bump into the precedingly conveyed sheet, and thus the occurrence of a paper jam at the time of pre-feeding can be suppressed.

Further, the image forming apparatus executes pre-feeding only when it is determined that a condition of lowering productivity at the time of duplex printing has been satisfied. Thus, when the productivity at the time of duplex printing is not lowered, control for pre-feeding may be omitted, and a processing burden of the image forming apparatus can be reduced.

Further, since the pre-feeding setting sheet number can appropriately change, it is possible to appropriately change the number of sheets necessary for suppressing productivity at the time of duplex printing according to a configuration of the image forming apparatus and the printing state. Thus, by preventing pre-feeding of the sheet number which is too excessive to suppress the productivity at the time of duplex printing and reducing the number of pre-fed sheets, loads simultaneously driven for pre-feeding are reduced, and instantaneous power consumption, noise, and the like can be reduced. Further, the system configuration of the image forming apparatus can be simplified, and consumption of a memory such as a RAM can be suppressed.

Modified Embodiment

The present embodiment is not limited to the above, and in an implementation stage, the embodiment may be implemented by altering components in a range not departing from the gist thereof. A variety of invention may be made by an appropriate combination of a plurality of components disclosed in the above embodiment. For example, several components may be deleted from all components illustrated in the above embodiment. In addition, components according to different embodiments may be appropriately combined. Furthermore, as will be described below, various modifications can be made.

In the above embodiment, various programs executed by the image forming apparatus may be configured to be stored in a computer connected to a network such as the Internet and provided by downloading via the network. Further, the various programs may be provided as file having an installable format or an executable format; and may be configured to be provided as a computer program product recorded on a computer readable recording medium such as a compact disc read only memory (CD-ROM), a flexible disk (FD), a compact disc rewritable (CD-R), and a digital versatile disk (DVD).

In the above embodiment, the image forming apparatus causes a copying function and a printer function to be implemented as a printing function, but only any one of printing functions may be implemented. Further, the image forming apparatus may perform color printing or monochrome printing.

In the above embodiment, in the principle (b) of the interleaf control, when "the number of non-printed sheets−n" is one (1), in order to further improve productivity, single-sided printing other than duplex printing may be performed as printing on the last sheet. Which of the two methods improves productivity depends on how excellent productivity of duplex printing is compared to single-sided printing in terms of a mechanical configuration or how long it takes a time to continuously perform back surface printing finally due to switching between duplex printing and single-sided printing. Further, under a certain condition, for example, when a preceding sheet and a subsequent sheet are different in linear velocity and loads inside an image forming apparatus compete with each other, interleaf control may not be performed at the time of duplex printing.

In the above embodiment, printing is performed on one sheet such that a front surface is first subjected to printing, and a back surface is then subjected to printing; but printing may be performed such that a back surface is first subjected to printing, and a front surface is then subjected to printing.

In the above embodiment, the printing process management unit 40, the printing order management unit 41, and the interleaf sheet number storage unit are provided. The printing process management unit 40 and the printing order management unit 41 are implemented by the CPU of the controller 33. Further, the printing process execution control unit 50, the first conveyance control unit 51, the re-feed position control unit 52, the second conveyance control unit 53, the pre-feeding management unit 54, the paper jam prevention interval management unit 55, the productivity interval management unit 56, and the transfer position alignment timing adjustment unit 57 are implemented by the CPU of the engine control unit 32. However, the present invention is not limited thereto. All of the components may be implemented by the CPU of the engine control unit 32 or the CPU of the controller 33. Any part of components which is implemented by the CPU of the controller 33 or the CPU of the engine control unit 32 is not limited.

Figure 14:
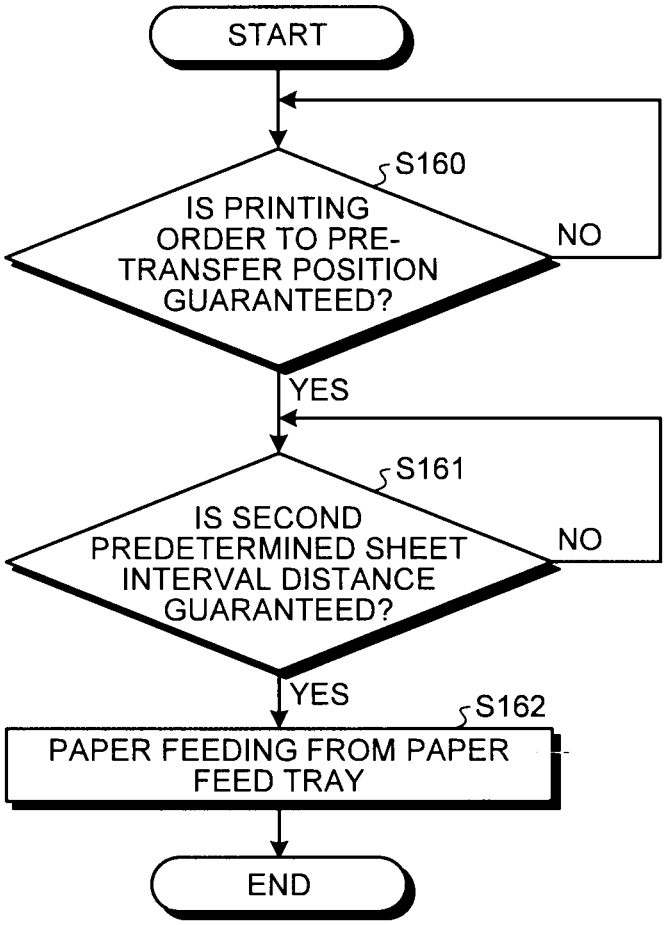
FIG. 14 is a flowchart illustrating a detailed procedure of a tray paper feeding position paper feeding control process.

In the above embodiment, after step S161 of FIG. 14, the engine control unit 32 may perform a confirmation process of confirming paper feeding conditions such as the fact that the sheet is housed in the paper feed tray 9 of the target from which the paper is fed (the residual amount of sheet may be zero (0), the fact that the conveying path from the paper feed tray 9 to the transfer position is present (the conveying path may not be present since the paper feed tray 9 is removed), and the fact that there is a balance when charging is performed on printing. When at least one of the paper feeding conditions has been difficult to confirm in the confirmation process, the engine control unit 32 may not perform processing of step S162.

At the time of duplex printing, an order between sheets which are targets on which front surface printing is performed does not change regardless of the execution of pre-feeding; and thus even when at least one of the paper feeding conditions has been difficult to confirm in the confirmation process, there is no influence on the sheet of the target on which printing is precedingly performed.

Figure 15:
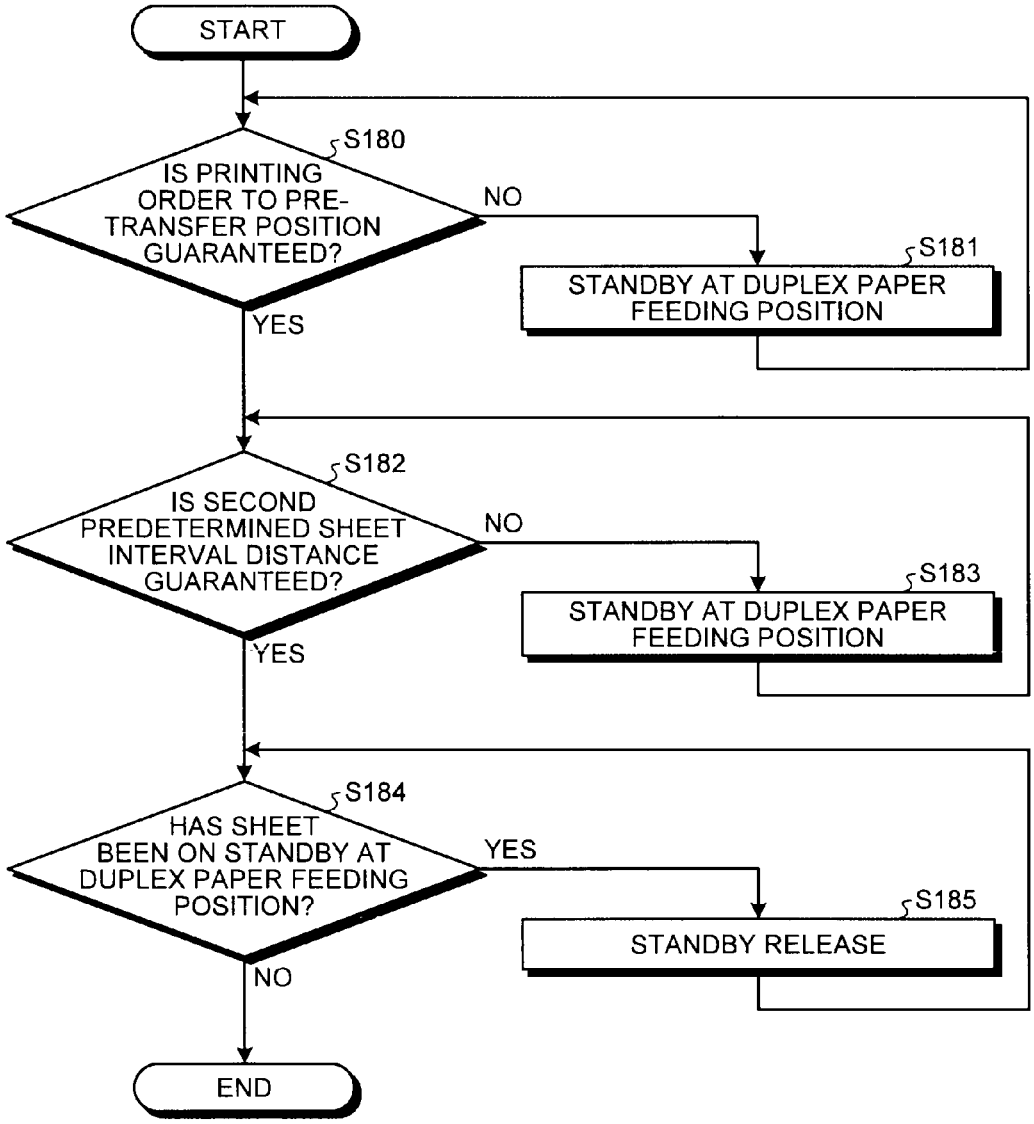
FIG. 15 is a flowchart illustrating a detailed procedure of a duplex paper feeding position paper feeding control process.

Further, similarly, after step S182 of FIG. 15, the engine control unit 32 may perform the confirmation process for confirming the paper feeding condition such as the fact that there is a balance when charging is performed on printing. When at least one of the paper feeding conditions has been difficult to confirm in the confirmation process, the engine control unit 32 may not perform processing of step S184 and step S185.

In the above embodiment, when the sheet is caused to be on standby at the re-feed position in step S152 or step S154 of FIG. 11, the sheet which has been pre-fed subsequent to the corresponding sheet is also caused to be on standby. However, driving and the suspension of driving of the paper feeding roller 13 that convey these sheets may be respectively controlled by separate motors; and the standby and the release of the standby of these sheets may be individually controlled. For example, on the sheet which has been pre-fed subsequent to the sheet caused to be on standby at the re-feed position may be conveyed to the position not to bump into the preceding sheet and then appropriately on standby; and when the sheet caused to be on standby at the re-feed position starts to be feed from the re-feed position, the sheet which has been pre-fed subsequent to the corresponding sheet may start to be conveyed at a point in time when the subsequent sheet is apart from the preceding sheet by the second predetermined sheet interval distance.

In the above embodiment, the first predetermined sheet interval distance and the second predetermined sheet interval distance may have the same value or different values.

According to the present embodiment, it is possible to guarantee a printing order or a sheet interval between a sheet of a back surface printing target and a sheet of a front surface printing target while suppressing a decrease in productivity at the time of duplex printing.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a first paper feeding control unit that feeds a sheet from a sheet stacking unit housing the sheet and conveys the sheet to a transfer position at which a transfer unit is disposed;

a transfer unit that transfers a toner image formed on a photosensitive element onto a front surface or a back surface of the sheet;

a second paper feeding control unit that reverses the sheet on which a transfer on the front surface has been already performed and then conveys the sheet to the transfer position via a first paper feeding position when a transfer is to be performed on each of both sides of the sheet;

a first decision unit that decides a transfer order on each surface of each of a plurality of sheets when transfer is to be performed by interleaf control according to a print job instructing printing on both sides of the plurality of sheets;

an execution control unit that controls the first paper feeding control unit at the time of transfer on the front surface of each sheet based on an order decided by the first decision unit according to the print job, causing the sheet to be fed from the sheet stacking unit, controls transfer performed by the transfer unit on the front surface of the sheet, controls the second paper feeding control unit at the time of transfer on the back surface, causing the sheet to be fed from the first paper feeding position, and controls transfer performed by the transfer unit on the back surface of the sheet; and a second decision unit that, when a predetermined condition is satisfied, decides that a second sheet, which is a transfer target on a front surface subsequent to the transfer on a back surface of a first sheet, is to be fed from the sheet stacking unit, earlier than the first sheet, in which transfer on a front surface has been finished and which is a transfer target on the back surface, is fed from the first paper feeding position, wherein the execution control unit controls the first paper feeding control unit according to a decision of the second decision unit and causes the second sheet to be fed from the sheet stacking unit, and the first paper feeding control unit controls the conveyance of the second sheet from the sheet stacking unit to the transfer position such that the first sheet is apart from the second sheet by a predetermined sheet interval distance or more without changing a transfer order on the back surface of the first sheet and a transfer order on the front surface of the second sheet fed from the sheet stacking unit, according to the decision of the second decision unit.

2. The image forming apparatus according to claim 1, wherein the second decision unit includes a determination unit that determines whether or not productivity becomes lower when the second sheet is fed from the sheet stacking unit after the first sheet is fed from the first paper feeding position, and an execution decision unit that decides that the second sheet is to be fed earlier than the first sheet when the determination unit determines that the productivity becomes lower.

3. The image forming apparatus according to claim 2, wherein the determination unit determines whether or not the productivity becomes lower based on a difference between a time taken for conveying the second sheet from the sheet stacking unit to the transfer position and a time taken for conveying the first sheet from the first paper feeding position to the transfer position.

4. The image forming apparatus according to claim 2, wherein the determination unit determines whether or not the productivity becomes lower based on a difference between a distance from the sheet stacking unit to the transfer position and a distance from the first paper feeding position to the transfer position.

5. The image forming apparatus according to claim 2, wherein the determination unit determines that the productivity become lower when the second sheet is fed from a sheet stacking unit which has been previously set as a unit that lowers productivity.

6. The image forming apparatus according to claim 1, further comprising a third paper feeding control unit that controls a standby or release of a standby of the second sheet at a third paper feeding position between the sheet stacking unit and the transfer position, wherein the first paper feeding control unit causes the third paper feeding control unit to make the second sheet to be on standby, when the second decision unit decides that the second sheet is to be fed prior to the first sheet, when there is a possibility that a transfer order on the back surface of the first sheet and a transfer order on the front surface of the second sheet fed from the sheet stacking unit are to change, and causes the third paper feeding control unit to make the standby release and feed the second sheet from the third paper feeding position, when the second decision unit decides that the second sheet is to be fed prior to the first sheet, when a transfer order on the back surface of the first sheet and a transfer order on the front surface of the second sheet fed from the sheet stacking unit do not change, and when a sheet interval between the first sheet and the second sheet is a predetermined sheet interval distance or more.

7. The image forming apparatus according to claim 6, further comprising a registration roller that adjusts timing with transfer transferred by the transfer unit and feeds a target sheet, on which transfer is performed, to the transfer unit, wherein the third paper feeding position is between the sheet stacking unit and a position at which the registration roller is disposed, and the third paper feeding control unit causes the second sheet to be on standby at the third paper feeding position when the second decision unit decides that the second sheet is to be fed prior to the first sheet, and when there is a possibility that a transfer order on the back surface of the first sheet and a transfer order on the front surface of the second sheet fed from the sheet stacking unit are to change, and causes the standby to release and feed the second sheet from the third paper feeding position and conveys the second sheet to the registration roller, when the execution decision unit decides that the second sheet is to be fed prior to the first sheet, when a transfer order on the back surface of the first sheet and a transfer order on the front surface of the second sheet fed from the sheet stacking unit do not change, and when a sheet interval between the first sheet and the second sheet is a predetermined sheet interval distance or more.

8. The image forming apparatus according claim 1, further comprising:

a storage unit that stores a maximum number of the second sheets that are able to be fed prior to the first sheet; and a changing unit that changes the number of sheets stored in the storage unit.

9. The image forming apparatus according to claim 1, wherein the decision unit decides that the second sheet is not to be fed prior to the first sheet, when the printing is charged, and when a balance is subtracted in an order in which sheets are fed from the sheet stacking unit.

10. A computer program product comprising a non-transitory computer usable medium having computer readable program codes embodied in the medium that, when executed, cause a computer used in an image forming apparatus to execute functions as:

a first paper feeding control unit that feeds a sheet from a sheet stacking unit housing the sheet and conveys the sheet to a transfer position at which a transfer unit is disposed;

a second paper feeding control unit that reverses the sheet on which a transfer on a front surface has been already performed and then conveys the sheet to the transfer position via a first paper feeding position when a transfer is to be performed on each of both sides of the sheet transferred by a transfer unit that transfers a toner image formed on a photosensitive element onto the front surface or a back surface of the sheet;

a first decision unit that decides a transfer order on each surface of each of a plurality of sheets when transfer is to be performed by interleaf control according to a print job instructing printing on both sides of the plurality of sheets;

an execution control unit that controls the first paper feeding control unit at the time of transfer on the front surface of each sheet based on an order decided by the first decision unit according to the print job, causing the sheet to be fed from the sheet stacking unit, controls transfer performed by the transfer unit on the front surface of the sheet, controls the second paper feeding control unit at the time of transfer on the back surface, causing the sheet to be fed from the first paper feeding position, and controls transfer performed by the transfer unit on the back surface of the sheet; and a second decision unit that, when a predetermined condition is satisfied, decides that a second sheet, which is a transfer target on a front surface subsequent to the transfer on a back surface of a first sheet, is to be fed from the sheet stacking unit, earlier than the first sheet, in which transfer on a front surface has been finished and which is a transfer target on the back surface, is fed from the first paper feeding position, wherein the execution control unit controls the first paper feeding control unit according to a decision of the second decision unit and causes the second sheet to be fed from the sheet stacking unit, and the first paper feeding control unit controls the conveyance of the second sheet from the sheet stacking unit to the transfer position such that the first sheet is apart from the second sheet by a predetermined sheet interval distance or more without changing a transfer order on the back surface of the first sheet and a transfer order on the front surface of the second sheet fed from the sheet stacking unit, according to the decision of the second decision unit.

* * * * *